US010883343B2

(12) United States Patent
Reid et al.

(10) Patent No.: US 10,883,343 B2
(45) Date of Patent: Jan. 5, 2021

(54) DOWNHOLE SCREEN ASSEMBLY

(71) Applicant: WEATHERFORD U.K. LIMITED, Leicestershire (GB)

(72) Inventors: Stephen Reid, Loughborough (GB); Andrew McGeoch, Loughborough (GB); Matthew Manning, Loughborough (GB); Daniel George Purkis, Loughborough (GB)

(73) Assignee: WEATHERFORD U.K. LIMITED, Leicestershire (GB)

( * ) Notice: Subject to any disclaimer, the term of this patent is extended or adjusted under 35 U.S.C. 154(b) by 0 days.

(21) Appl. No.: 16/239,449

(22) Filed: Jan. 3, 2019

(65) Prior Publication Data

US 2019/0136672 A1 May 9, 2019

Related U.S. Application Data

(62) Division of application No. 15/113,675, filed as application No. PCT/GB2015/050133 on Jan. 21, 2015.

(30) Foreign Application Priority Data

Jan. 22, 2014 (GB) ..... 1401066.4

(51) Int. Cl.
*E21B 43/04* (2006.01)
*E21B 43/08* (2006.01)
(Continued)

(52) U.S. Cl.
CPC ..... *E21B 43/045* (2013.01); *E21B 17/1078* (2013.01); *E21B 34/06* (2013.01);
(Continued)

(58) Field of Classification Search
CPC ..... E21B 43/08; E21B 43/086; E21B 43/045; E21B 43/082; E21B 43/084;
(Continued)

(56) References Cited

U.S. PATENT DOCUMENTS 3,213,950 A 10/1965 Ghelfi et al.
5,337,808 A * 8/1994 Graham ..... E21B 33/124 166/191
(Continued)

FOREIGN PATENT DOCUMENTS

WO 03/064811 A2 8/2003
WO 2004/099560 A1 11/2004
(Continued)

OTHER PUBLICATIONS

PCT Search Report and Written Opinion filed in counterpart PCT application No. PCT/GB2015/050133; dated Aug. 21, 2015; 6 pages.
(Continued)

*Primary Examiner* — David Carroll
(74) *Attorney, Agent, or Firm* — Blank Rome LLP

(57) ABSTRACT

A screen assembly, such as a downhole/sand screen assembly, comprising first and second screen portions or screens longitudinally coupled together, wherein there is provided a fluid flow path between the first and second screen portions or screen. Optionally, the first and second sleeves are coupled or connected by a centralizer or further sleeve or screen, and/or optionally by or via first and second support ring.

13 Claims, 27 Drawing Sheets

(51) Int. Cl.
*E21B 43/16* (2006.01)
*E21B 17/10* (2006.01)
*E21B 34/06* (2006.01)

(52) U.S. Cl.
CPC ..... *E21B 43/08* (2013.01); *E21B 43/086* (2013.01); *E21B 43/162* (2013.01); *E21B 43/082* (2013.01); *E21B 43/084* (2013.01); *E21B 43/088* (2013.01); *E21B 2200/06* (2020.05)

(58) Field of Classification Search
CPC .. E21B 43/088; E21B 34/06; E21B 2034/007; E21B 37/08
See application file for complete search history.

(56) References Cited

U.S. PATENT DOCUMENTS 5,476,143 A 12/1995 Sparlin et al.
5,579,844 A * 12/1996 Rebardi ..... E21B 34/14 166/126
5,868,200 A 2/1999 Bryant et al.
6,382,318 B1 * 5/2002 Whitlock ..... B01D 29/15 166/278
6,719,051 B2 * 4/2004 Hailey, Jr. ..... E21B 34/06 166/236
8,511,380 B2 8/2013 Guignard et al.
2002/0079099 A1 6/2002 Hurst et al.
2003/0173075 A1 9/2003 Morvant et al.
2009/0078427 A1 * 3/2009 Patel ..... E21B 43/10 166/372
2009/0095471 A1 4/2009 Guignard et al.
2011/0002410 A1 1/2011 Forenza et al.
2011/0024105 A1 2/2011 Hammer et al.
2011/0220347 A1 9/2011 Kayser
2011/0303420 A1 12/2011 Thorkildsen et al.
2012/0018146 A1 1/2012 Wildhack
2017/0074077 A1 3/2017 Bowen et al.

FOREIGN PATENT DOCUMENTS

WO 2007/092082 A2 8/2007
WO 2014/070135 A1 5/2014
WO 2016/018821 A2 2/2016

OTHER PUBLICATIONS

Examination Report No. 2 in counterpart AU Appl. 2015208913, dated Feb. 15, 2018, 6-pgs.
Examination Report No. 2 in counterpart AU appl. 2018201761, dated Sep. 17, 2019, 6-pgs.

* cited by examiner

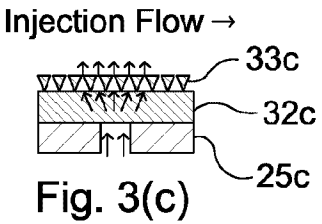
Fig. 3(c)
Fig. 3(b)
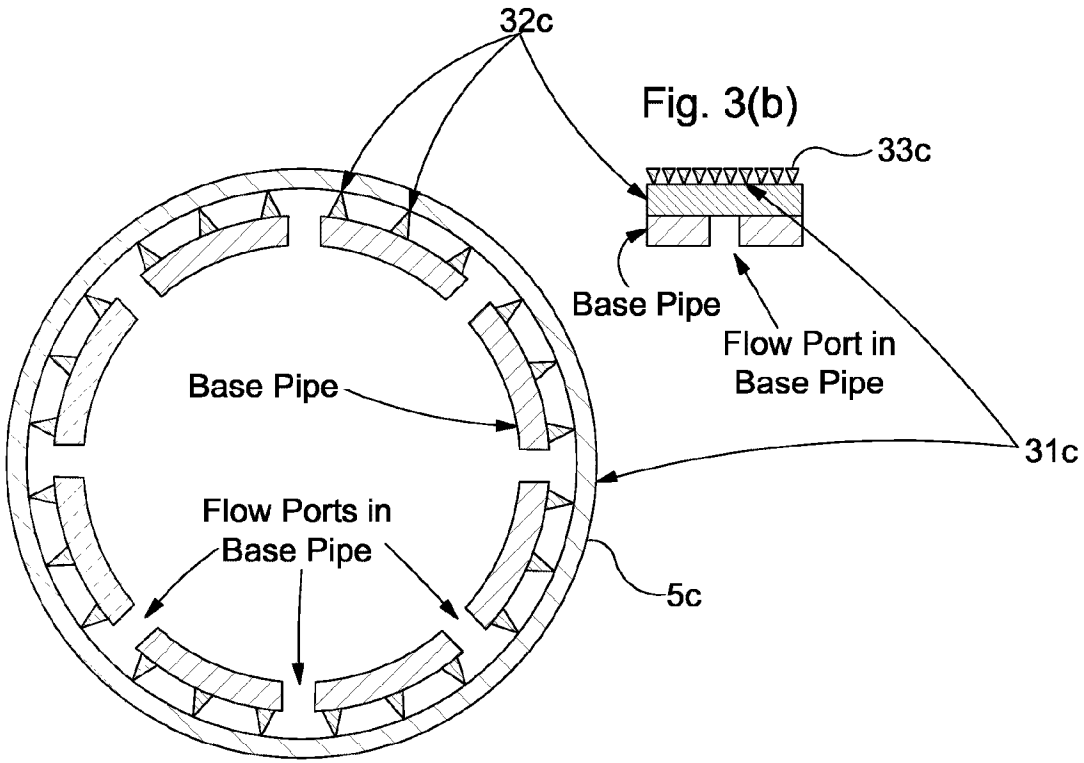
Fig. 3(a)

DOWNHOLE SCREEN ASSEMBLY

CROSS-REFERENCE TO RELATED APPLICATIONS

This is a divisional of U.S. patent application Ser. No. 15/113,675 and filed 22 Jul. 2016, which is incorporated herein by reference in its entirety and to which priority is claimed.

FIELD OF INVENTION

The present invention relates to downhole tools. The present invention relates to screens, such as downhole screens, such as sand screens.

Screens are used in tubular systems to separate particulate from fluids. Such systems are used in the downhole completion field to separate sand and other particulate from fluids, e.g. production fluids or hydrocarbons, such as oil, water and gas.

BACKGROUND TO INVENTION

As outlined in WO2004/099560 (BP EXPLORATION), in the course of completing an oil and/or gas well, it is common practice to run a string of casing into the well-bore and then to run the production tubing inside the casing. The casing is perforated across one or more hydrocarbon bearing zones (hereinafter 'producing zones') to allow produced fluids to enter the casing bore. After the well is completed and placed in production, formation sand from unconsolidated formations may be swept into the flow path along with produced fluids. This sand is relatively fine and causes erosion of tubing, downhole equipment and surface equipment. In some completions, however, the well bore is uncased, and an open face is established across the producing zone, in particular, in horizontal well completions. Similarly, after the well is completed and placed in production, formation sand from unconsolidated formation may be swept into the flow path along with produced fluids.

With either cased or uncased well-bores, one or more sand screens may be installed in the flow path between the production tubing and the producing zone(s). A packer may be set above and below the sand screen to seal off the annulus in the producing zone from non-producing zones of the formation. The annulus around the screen may be packed with a relatively coarse sand or gravel which acts as a filter to reduce the amount of fine formation sand reaching the screen. Nevertheless, the remaining sand contained in the produced fluids may impinge on a screen with sufficient velocity so as to cause erosion of the screen. As the velocity of the flow of the produced fluids is increased, the rate of erosion also increases. Where the fluid flow rate from one portion of the formation is greater than the fluid flow rate from another portion of the formation, the screen will erode more rapidly opposite the high flow rate portion than it will opposite the lower flow rate portion.

WO2004/099560 (BP EXPLORATION) discloses a sand screen comprising a perforated base pipe and an erosion resistant microporous sleeve. The erosion resistant microporous material of the sleeve is selected from the group consisting of microporous polymeric foams, microporous metal foams, microporous carbide monoliths, and microporous nitride monoliths.

WO2011/130122 (BAKER HUGHES) discloses a screen device including a foam body having a passageway that extends longitudinally through the foam body, the foam body having an open cell structure such that at least two surfaces of the foam body are in fluidic communication with one another through the foam body.

In well completions having screened pipe, the screened pipe typically comprises base pipe (or inner pipe) overlaid by a screen (or outer jacket). The base pipe can be solid or slotted. The outer screen has hole or port dimensions selected to filter out particles above a desired size during production. The screen can be attached to the base pipe by axial support rods welded to an outer surface of the base pipe, which rods are then overlaid circumferentially by wire with a triangular cross-section. The points of the triangular wire are welded to the axial support rods. Between the rods, at least partly annular spaces are created between the circumferential wire wrap screen and the base pipe.

There has been identified a need for the base pipe to be isolated from the through-bore initially so that some other operations can be performed. Therefore, if the base pipe is solid, the openings that provide through-bore communication need to be initially closed. If the base pipe is perforated/slotted, the perforations need initially to be sealed. Prior to production, there may be a wish to stimulate the well by injecting fluids into the hydrocarbon (HC) formation in a reverse direction to production. Since injection involves pumping of high pressure/flow rate fluids through the screen in a reverse direction, the screen must be able to withstand erosion in both directions (covering injection followed by production). In addition there may be a wish to distribute injected fluids in a uniform manner across the hydrocarbon formation (if possible) to seek to ensure all portions of the formation are equally stimulated.

There may be a desire that the annulus between the screen and the base pipe of all adjacent sand screen joints can be or is inter-connected.

It is an object of at least one general solution or aspect of the present invention to obviate or at least mitigate one or more problems and/or disadvantages in the prior art.

SUMMARY OF INVENTION

According to a first aspect of the present invention there is provided a screen or screen assembly, such as a downhole/sand screen or screen assembly, comprising a pipe and a sleeve and at least one support provided between the pipe and the sleeve, wherein the at least one support has a cross-section comprising first and second points, vertices, surface discontinuities and/or corners. Such support shape may provide enhanced erosion resistance. The pipe may be referred to as a base pipe or production tubing. The pipe may be perforated and/or comprise a plurality of ports. Alternatively the pipe may be solid, e.g. comprise a solid tubular wall or tubular wall section(s). The first and second points, vertices, surface discontinuities and/or corners (hereinafter 'points') may comprise a pair of points. The first and second points may face in substantially opposing directions, e.g. along a radial direction, e.g. of the pipe and/or the sleeve. The at least one support may comprise a plurality of supports, e.g. axial supports and/or support rods. The supports may be disposed in an annular space between the pipe and the sleeve. The sleeve may be provided around the pipe.

In one implementation the/each support may have a cross-section comprising a polygon having at least four sides and/or which is a parallelogram, rectilinear, or beneficially square or diamond shape.

In another implementation the/each support may have a cross-section comprising a polygon having six sides, e.g. a polygon having opposing triangular end portions and a rectilinear or square mid-portion. A first point may be welded to the pipe, e.g. an outer surface of the pipe. A second point may be welded to the sleeve, e.g. an inner surface(s) of the sleeve. The support(s) may be made from steel.

According to a second aspect of the present invention there is provided a screen or screen assembly, such as a downhole/sand screen or screen assembly, wherein the screen comprises wire having a cross-section comprising first and second points, vertices, surface discontinuities and/or corners. Such wire shape may provide enhanced erosion resistance. The first and second points, vertices, surface discontinuities and/or corners (hereinafter 'points') may comprise a pair of points. The first and second points may face in substantially opposing directions, e.g. along a radial direction, e.g. of a pipe and/or a sleeve. The screen may comprise a pipe and a sleeve (the sleeve comprising the wire/screen), and at least one support. The pipe may be referred to as a base pipe or production tubing. The at least one support may comprise a plurality of supports, e.g. axial supports and/or support rods. The pipe may be perforated and/or comprise a plurality of ports. Alternatively the pipe may be solid, e.g. comprise a solid tubular wall or tubular wall section(s). The supports may be disposed in an annular space between the pipe and the sleeve. The sleeve may be provided around the pipe.

In one implementation the/each wire may have a cross-section comprising a polygon having at least four sides and/or which is rectilinear or beneficially square or diamond shape.

In another implementation the/each wire may have a cross-section comprising a polygon having six sides, e.g. a polygon having opposing triangular end portions and a rectilinear or square mid-portion. A first point may be welded to a support or to the pipe, e.g. to an outer surface of the support or pipe. A second point may face radially out, e.g. towards a formation or inner facing surface of a borehole. The wire may be made from steel.

According to a third aspect of the present invention there is provided a screen or screen assembly, such as a downhole/sand screen or screen assembly, wherein the screen comprises wire having a cross-section comprising a rectilinear shape or parallelogram. Such wire shape may provide enhanced erosion resistance. The rectilinear shape or parallelogram may comprise a rectangle or in a preferred implementation may comprise a square or diamond shape. The wire may be disposed such that a line of symmetry of the rectilinear shape is provided along a radial direction of the screen. The screen may comprise a pipe and a sleeve (the sleeve beneficially comprising the wire/screen), and at least one support. A side of the wire may be welded to the supports(s).

According to a fourth aspect of the present invention there is provided a screen or screen assembly, such as a downhole/sand screen or screen assembly, comprising coated and/or hardened wire. The wire may be made from steel. In one implementation the coating may be tungsten carbide, e.g. hardide tungsten carbide. The coating may be applied or deposited by chemical vapour deposition (CVD)—which may be applied to steel. The wire may be heat treated so as to harden. The screen may comprise a pipe and a sleeve, the sleeve comprising the wire, and optionally at least one support. The wire may be provided in coated and/or hardened lengths and made-up or assembled in longer lengths so as to provide the sleeve.

Accordingly to a fifth aspect of the present invention there is provided a screen or screen assembly, such as a downhole or sand screen or screen assembly, comprising a pipe and a plurality of ceramic discs around the pipe. Such may provide enhanced erosion resistance. The ceramic discs may be stacked on each other. The pipe may be referred to as a base pipe or production tubing. The pipe may be perforated and/or comprise a plurality of ports. The pipe may be slotted. Alternatively the pipe may be solid. The pipe may comprise a plurality of ports, e.g. slots, e.g. circumferentially and/or axially spaced thereupon. One or more of the discs may be arranged so as to provide circumferential/annular spaces between the pipe and the respective disc.

Between adjacent circumferential/annular spaces the disc(s) may be arranged such that there is no gap (e.g. radial gap) between the pipe and the disc. Such arrangement may be provided by portions of the disc having reduced internal diameter, e.g. such that the pipe and the disc(s) radially abut or contact one another at said portions. The space(s) may extend longitudinally between adjacent discs. The space(s) may be aligned, e.g. rotationally aligned, with at least one port in the pipe. A valve member may be provided between a port and a respective space. The/each valve member may comprise a slidable member, e.g. a longitudinally slidable member. Each valve member may comprise at least one further port and/or at least one reed valve which may be (longitudinally) selectively alignable with or out of alignment with a port of the pipe. The screen or screen assembly may also comprise an inner sleeve. The inner sleeve may be slidable relative to the pipe. An outer surface of the inner sleeve may abut or contact an inner surface of the pipe. The inner sleeve may comprise at least one yet further port or further reed valve which may be (longitudinally) selectively alignable with or out of alignment with a port of the pipe.

Accordingly to a sixth aspect of the present invention there is provided a screen or screen assembly, such as a downhole/sand screen or screen assembly, comprising a pipe and/or tubular and a sleeve, wherein the pipe and/or tubular comprises a plurality of slotted ports or longitudinally extending ports. Such arrangement may provide enhanced erosion resistance. The sleeve may comprise a microporous sleeve. The pipe may comprise a base pipe or production tubing. The tubular may comprise a further sleeve, e.g. inner sleeve, e.g. sliding sleeve.

According to a seventh aspect of the present invention there is provided a screen or screen assembly, such as a downhole screen or screen assembly, comprising a pipe or sleeve, wherein the pipe comprises a solid or non-perforated pipe. Such arrangement may provide enhanced erosion resistance. The solid or non-perforated pipe may comprise an opening(s) or port(s) at or adjacent an end(s) thereof, e.g. to deliver injection fluid to a formation.

The following optional features apply to any foregoing aspect such as the sixth and seventh aspects. The pipe may be referred to as a base pipe or production tubing. The microporous sleeve may be an erosion resistant microporous sleeve. The microporous sleeve may comprise a material selected from a metal foam or a ceramic foam. The microporous sleeve may comprise a material selected from the group consisting of microporous polymeric foams, microporous metal foams, microporous carbide monoliths, in particular, silicon carbide, tungsten carbide, or titanium carbide monoliths or microporous nitride monoliths, such as boron nitride. The microporous sleeve may intimately contact and/or be bonded to an outer surface of the pipe.

According to an eighth aspect of the present invention there is provided a screen or screen assembly, such as a downhole/sand screen or screen assembly, comprising a pipe and a sleeve, wherein the pipe comprises openings or ports (such as longitudinal or axial opening(s) or slot(s)) and the sleeve comprises a foam or microporous material, the sleeve being bonded with or to an exterior surface of the pipe.

Such arrangement may provide enhanced erosion resistance. Such arrangement may provide relatively even distribution of injection fluids. The pipe may be referred to as a base pipe. The openings or slots may comprise or be referred to as daisy passages. The opening or slots may, in use, fluidically communicate with the sleeve.

Accordingly to the ninth aspect of the present invention there is provided a screen or screen assembly, such as a downhole/sand screen or screen assembly, comprising a pipe having at least one port or perforation or hole, the/each port or perforation or hole having an associated valve. The pipe may be referred to as a base pipe. The/each valve may be a check valve. The pipe may comprise a plurality of ports or perforations or holes (hereinafter "port"), each port having an associated valve. The/each valve may, in use, initially be provided to isolate the inner diameter of the pipe from the outer diameter of the pipe. Upon opening the valve(s) the provision of multiple ports in the pipe may provide improved distribution of injection fluid. The/each valve may comprise a valve member. The/each valve member may be deployable by or comprise a sliding sleeve and/or be deployable by pressure of fluid flow, in use. The sliding sleeve may slide relative to an inner surface of the pipe. The sliding sleeve may comprise a port(s) which may be controllably aligned with ports of the pipe. The valve member(s) may be biased into a closed position, e.g. by biasing means.

In one implementation the valve member(s) may comprise a spherical member(s), e.g. biased spherical member(s). The/each spherical member may be provided, e.g. movably provided, within a space provided by a port in the pipe and a recessed portion in a sleeve. In yet another implementation the valve member(s) may comprise a flap, e.g. thin metallic or steel flap or reed valve. In still yet another implementation the valve member(s) may comprise one or more sliding sleeve(s).

According to a tenth aspect of the present invention there is provided a screen or screen assembly, such as a downhole/sand screen or screen assembly, comprising a pipe having at least one port or perforation or hole, and at least one sleeve provided within the pipe, the screen having at least one respective port or perforation or hole which in a closed position is not aligned or is misaligned with the at least one port or perforation or hole in the pipe but which in an open position is alignable or aligned with the at least one port or perforation or hole in the pipe.

The pipe may be referred to as a base pipe or production tubing. The/each sleeve (internal sleeve) may comprise a shift sleeve. The/each sleeve may beneficially be provided internal of or within the pipe. The/each sleeve may be slidable relative to the pipe so as to move from a closed to open position and optionally vice versa. The pipe may comprise a plurality of ports or perforations or holes. The/each sleeve (internal sleeve) may comprise a plurality of respective ports or perforations or holes. The presence of multiple ports/perforations/holes may allow for improved distribution of injection fluid. The screen may comprise an (outer) sleeve or screen sleeve, e.g. comprising wire.

According to an eleventh aspect of the present invention there is provided a screen or screen assembly, such as a downhole/sand screen or screen assembly, comprising a pipe and a plurality of sleeves. The pipe may be referred to as a base pipe. The sleeves (inner sleeves) may be provided within the pipe. The sleeves may each comprise a sliding/shift sleeve. The sleeves may be tubular. There may be provided first and second sleeves, e.g. one provided within the other. Movement, e.g. sequential movement, of the sleeves may cause alignment or misalignment, of ports in the pipe and the sleeve(s), e.g. opening or closing, of the screen. Sliding movement of a first sleeve may cause sliding movement of a second sleeve, e.g. to open the screen. Sliding movement of a second sleeve may cause sliding movement of a first sleeve, e.g. to close the screen.

According to a twelfth aspect of the present invention there is provided a screen or screen assembly, such as a downhole/sand screen or screen assembly, comprising a pipe comprising at least one port/perforation/hole, the or each port having a respective seal or plug. The pipe may be referred to as a base pipe. The pipe may comprise a plurality of ports. In a closed disposition the respective seal or plug may be received or be provided within or adjacent to the respective port. In an open disposition the respective seal or plug may be provided distal the respective port. A transition from a closed disposition to an open disposition may be achieved at or above a predetermined threshold flow rate of fluid acting on the plug. The seal(s) or plug(s) may be carried by a sleeve, e.g. on an outer surface of a shifting/sliding sleeve provided within the pipe.

According to a thirteenth aspect of the present invention there is provided a screen assembly, such as a downhole/sand screen assembly, comprising at least a first screen according to any preceding aspect of the present invention and a second screen. The first screen and second screen may be longitudinally disposed relative to one another. The first screen may be selected to be provided in high(er) flow areas, e.g. production and/or injection fluid flow areas. The first screen may have a higher erosion resistance than the second screen. The first screen may comprise or include a microporous material, e.g. ceramic material, for example, a foamed ceramic or metal, or ceramic discs. The second screen may be selected to be provided in low(er) flow areas, e.g. production and/or injection fluid flow areas. The second screen may comprise wire having a cross-section comprising a triangular shape. Alternatively the second screen may comprise wire having a cross-section comprising a square shape.

According to a fourteenth aspect of the present invention there is provided a screen or screen assembly, such as a downhole/sand screen or screen assembly, comprising a pipe and a sleeve, wherein the screen or pipe comprises a port(s) and the sleeve comprises a solid or wall portion(s) or baffles at or near the port(s). The solid or wall portions or baffles may be provided radially outward of the port(s). The pipe may be referred to as a base pipe. The port(s) may be provided on the pipe and/or at each end of the pipe; in the latter case the pipe optionally having a solid wall. The solid or wall portion(s) may be provided radially adjacent the port(s), e.g. radially outward of the port(s). This arrangement may provide that injection flow, e.g. high rate injection flow, may meet or hit a solid or wall portion, change direction and flow axially along an annulus between the pipe and the sleeve. In this way an area of highest erosion is deflected to an area of pipe having a solid outer wall.

According to a fifteenth aspect of the present invention there is provided a screen assembly, such as a downhole/sand screen assembly, comprising first and second screen portions or screens longitudinally coupled together, wherein there is provided a fluid flow path between the first and second screen portions or screen. The first screen may comprise a first pipe and a first sleeve. The second screen may comprise a second pipe and a second sleeve. The first and second pipes may be coupled, e.g. by a coupling, e.g. a threaded coupling. The first and second sleeves may be coupled or connected by a centraliser or further sleeve or screen, and/or optionally by or via first and second support rings. The fluid flow path may be annular. The centralizer or further sleeve or screen may form a portion of the fluid flow path.

According to a sixteenth aspect of the present invention there is provided a screen assembly, such as a downhole/sand screen assembly, comprising first and second screens longitudinally disposed relative to one another, wherein a centraliser is provided between adjacent ends of the first and second screens. A first support ring may be provided between an end of a sleeve of the first screen and a first end of the centralizer. A second support ring may be provided between an end of a sleeve of the second screen and a second end of the centralizer.

According to a seventeenth aspect of the present invention there is provided a screen assembly, such as a downhole/sand screen assembly, comprising first and second screens longitudinally disposed relative to one another, wherein a further screen or screen portion is provided between adjacent ends of the first and second screens. A first support ring may be provided between an end of a sleeve of the first screen and a first end of the further screen. A second support ring may be provided between an end of a sleeve of the second screen and a second end of the further screen.

According to an eighteenth aspect of the present invention there is provided a screen or screen assembly, such as a downhole/sand screen or screen assembly comprising a pipe and a plurality of ceramic discs stacked on each other, wherein at least one spacer is provided between two adjacent discs, wherein the/each at least one spacer is aligned with a respective hole or slot or perforation in the pipe. Such may provide enhanced erosion resistance. The pipe may be referred to as a base pipe or production tubing.

According to a nineteenth aspect of the present invention there is provided a screen or screen assembly, such as a downhole/sand screen or screen assembly, comprising a pipe and a plurality of ceramic discs stacked on each other, wherein at least one spacer is provided between at least two adjacent discs, wherein the/each spacer is shaped to diffuse fluid flow exiting a hole or slot or perforation in the pipe. Such may provide enhanced erosion resistance. The spacer may comprise first and second surfaces. The first and second surfaces may be concave. The first and second surfaces may face in opposing directions. Each of the first and second surfaces may be radially diverging. The pipe may be referred to as a base pipe or production tubing.

The eighteenth and nineteenth aspects may be combined. The following optional features apply at least to the eighteenth and nineteenth aspects: The discs may be provided around the pipe. The disc may be annular. Beneficially each spacer may be integrally formed with a disc. Beneficially each disc and/or each spacer may be made from a ceramic material.

In one implementation a plurality of longitudinally adjacent discs may provide a plurality of circumferentially adjacent spacers. Such may be rotationally aligned with a hole/slot/perforation in the pipe. The discs may provide a filter media. Adjacent discs may be spaced from one another, e.g. by the spacer(s). The spacer(s) may be provided on a surface or face of the/each disc. Spacer(s) may be provided around the surface or face of the/each disc.

According to a twentieth aspect of the present invention there is provided a screen assembly, such as a downhole/sand screen assembly, comprising a plurality of screens, wherein each screen comprises a pipe and a shifting sleeve, wherein the assembly is arranged such that the shifting sleeves are capable of being opened (and/or closed) sequentially. The sleeves may be opened in sequence from the furthest downhole towards surface.

According to a twenty first aspect of the present invention there is provided a downhole apparatus or assembly, or screen or screen assembly, such as a downhole/sand screen assembly, comprising a pipe having a port and an inner sleeve and a pin within the port. The pin may cause rotational locking or alignment between the pipe and the sleeve.

According to a twenty second aspect of the present invention there is provided a screen, or screen assembly, such as a downhole/sand screen or screen assembly, having enhanced erosion resistance.

It will be appreciated that the foregoing general solution or aspects of the present invention may be combined. It will be appreciated that any feature or features of one general solution or aspect of the present invention may be adopted or used in another general solution or aspect.

Any feature(s) of any one general solution or aspect may be combined with any feature(s) of any other general solution or aspect. Thus feature(s) defined in relation to one general solution or aspect may be provided in combination with feature(s) of any other general solution or aspect.

It will be appreciated that the pipe (or tubular) and/or the screen, first and/or second screens and/or the further screen may each comprise a hollow cylindrical shape, and may be disposed substantially co-axially, the sleeve typically surrounding the pipe.

The wire may comprise wire mesh. The screen or screen assembly may be configurable for one or more of fluid injection, stimulation, fracturing and/or production. The pipe may comprise production tubing. The pipe may comprise a first tubular. The pipe may be permeable or impermeable. The pipe may comprise a perforated tubular member or tubular member having a plurality of ports or may comprise a solid walled tubular member. The screen or sleeve (e.g. outer sleeve) may comprise a second tubular. The screen or sleeve (e.g. outer sleeve) may be permeable. The pipe may be disposed within a or the sleeve (e.g. outer sleeve). The pipe may define an axial through-bore. An annulus may be provided between the pipe and the sleeve (e.g. outer sleeve). The (further) sleeve(s), e.g. sliding sleeves, may comprise further tubulars. The wire may be circumferentially disposed or wound.

BRIEF DESCRIPTION OF DRAWINGS

Embodiments of the present invention will now be described by way of example only and with reference to accompanying drawings which are:

FIG. 3(*a*) is a transverse cross-sectional view of a screen according to the prior art;

FIGS. 3(*b*)-(*c*) are partial longitudinal cross-sectional views of the screen of FIG. 3(*a*);

FIG. 8(*c*) is a partial longitudinal cross-sectional view of a screen according to an embodiment of the present invention;

FIG. 8(*d*) is a partial longitudinal cross-sectional view of a screen according to an embodiment of the present invention;

FIGS. 9(*b*)-(*e*) are a series of longitudinal views of the screen of FIG. 9(*a*) in closed and opened dispositions;

FIG. 11(*b*) is a partial longitudinal cross-sectional view of a screen according to an embodiment of the present invention in a closed position;

FIGS. 12(*d*)-(*f*) are a sequence of longitudinal cross-sectional views illustrating closing of the screen of FIGS. 12(*a*)-(*c*);

FIGS. 13(*c*)-(*d*) are longitudinal cross-sectional views of a screen assembly according to an embodiment of the present invention;

FIG. 14(*b*) is a longitudinal view of the screen of FIG. 14(*a*);

FIG. 15(*d*) is a perspective view of a sliding sleeve of the screen of FIGS. 15(*a*)-(*c*);

FIGS. 16(*b*)-(*c*) are partial longitudinal cross-sectional views of the screen of FIG. 16(*a*) and a modification thereto; FIG. 16(*d*) a further partial longitudinal cross-sectional view of the screen of FIG. 16(*a*);

FIG. 19(*b*) is a partial longitudinal cross-sectional view of the screen of FIG. 19(*a*) to an enlarged scale;

FIG. 19(*c*) is a stack of discs of the screen of FIG. 19(*a*);

FIG. 19(*d*) is a partial perspective view of a ceramic disc of the stack of ceramic discs of FIG. 19(*c*);

DETAILED DESCRIPTION OF DRAWINGS

Figure 1:
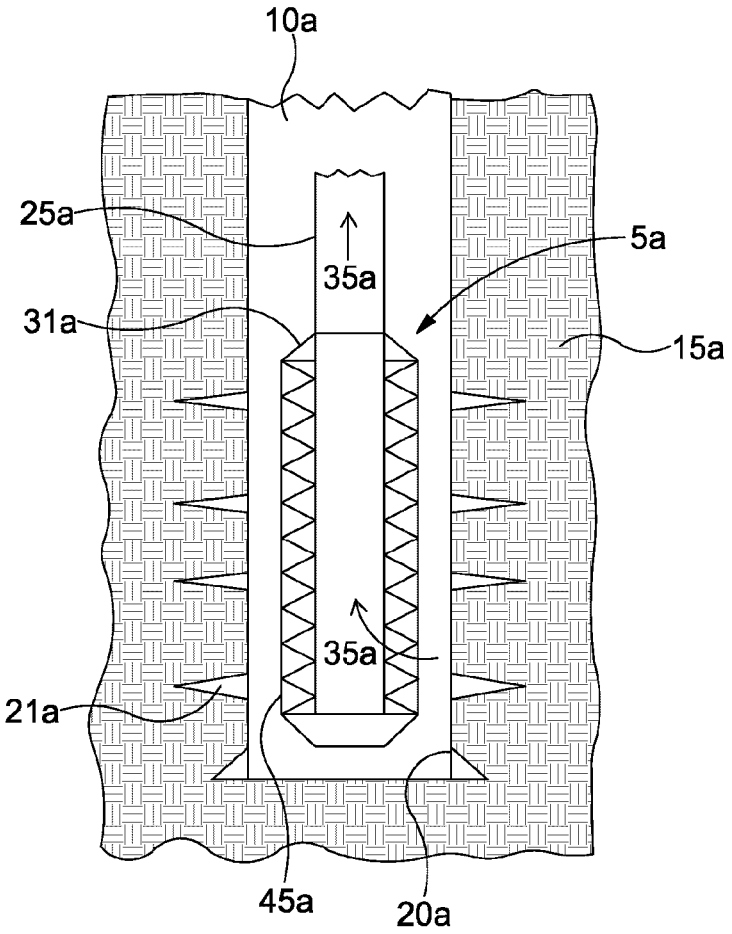
FIG. 1 is a cross-sectional view of a sand screen operatively positioned in a subterranean well-bore.

Referring to FIG. 1, there is illustrated a screen or sand screen, generally designated 5*a*, operatively positioned in a subterranean well-bore 10*a* adjacent to a formation 15*a* which has been lined with protective casing 20*a*. The casing 20*a* has been perforated 21*a* to permit fluid flow between formation 15*a* and well-bore 10*a*. Screen 5*a* is suspended from pipe or production tubing 25*a* which extends to a well-head 30*a* and comprises a permeable sleeve 31*a* formed from wire.

During production of fluids—represented by arrows 35*a*—from the formation 15*a*, the fluids enter the screen 5*a* and are transported to the well-head through the tubing 25*a*. Any sand in the fluid 35*a* should be filtered out by the screen 5*a* and not permitted to flow into the pipe 25*a*. The screen 5*a* is gradually eroded over time as the fluid 35*a* flows through the screen 5*a*. Higher rates of flow of the fluid 35*a* through the screen 5*a* cause faster erosion of the screen 5*a*. The screen 5*a* can also be used for injection of fluids into the formation—in a direction opposite to the arrows 35*a*.

If the rate of flow of the fluid through a particular perforation 21*a* is greater than the rate of flow of the fluid 35*a* through the other perforations 21*a*—as is frequently the case in gas wells—a portion 45*a* of the screen 5*a* opposite the high flow rate perforation 21*a* will erode faster than another portion or portions of the screen 5*a*. When the portion 45*a* of the screen 5*a* has eroded enough to permit sand and other debris to enter the tubing, the entire screen 5*a* must be replaced at great cost to the well operator, even though most of the screen 5*a* is not yet eroded.

Figure 2:
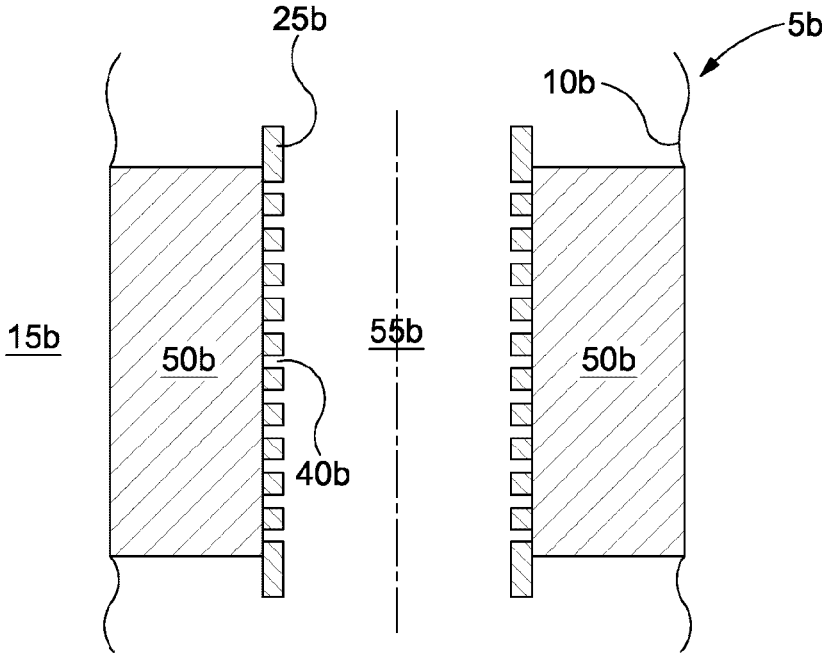
FIG. 2 is a cross-sectioned view of another sand screen operatively positioned in a subterranean well-bore.

Referring next to FIG. 2, there is illustrated an alternative screen or sand screen, generally designated 5*b*. The screen 5*b* is shown within a well-bore 10*b* of an earth formation 15*b*. The screen 5*b* has a cylindrical sleeve or foam body 50*b*, which in one implementation is an open cell foam body which surrounds a pipe or tubular 25*b* positioned within a through-bore or void 55*b* that extends longitudinally through the foam body or sleeve 50*b*. The foam body or sleeve 50*b* is an open cell structured foam which allows fluid to flow therethrough from an outside of the screen 5*b*, defined by an outer surface, to the void 55*b*. The cell structured foam provides filtering of fluid passing therethrough. Perforations or ports 40*b* in the pipe 25*b* allow fluid passing through the screen 5*b* to flow to an inside of the through-bore 55*b*. Once the fluid is on an inside of the through-bore 55*b* the fluid can flow longitudinally through the pipe 25*b* in either direction. Fluid initially on the inside of the through-bore 55*b* can also flow out through the perforations 40*b*, through the open cell structured foam and to the outside.

Referring now to FIGS. 3(*a*)-(*c*) there is shown a screen, such as a downhole/sand screen, 5*c* according to the prior art. The screen 5*c* comprises a pipe (tubular) 25*c* and a sleeve (permeable sleeve) 31*c* and a plurality of circumferentially disposed supports 32*c* provided between the pipe 25*c* and the sleeve 31*c*, wherein each support 32*c* has a cross-section comprising a triangular shape.

Further the sleeve 31*c* comprises wire 33*c* which has a cross-section comprising a further triangular shape. The wire 33*c* is circumferentially disposed or wound.

There will now be illustrated, by way of non-limiting example only, a number of embodiments of screens or screen assemblies according to the present invention which may find utility in well-bore completions as shown in FIG. 1 and/or FIG. 2.

Figure 4:
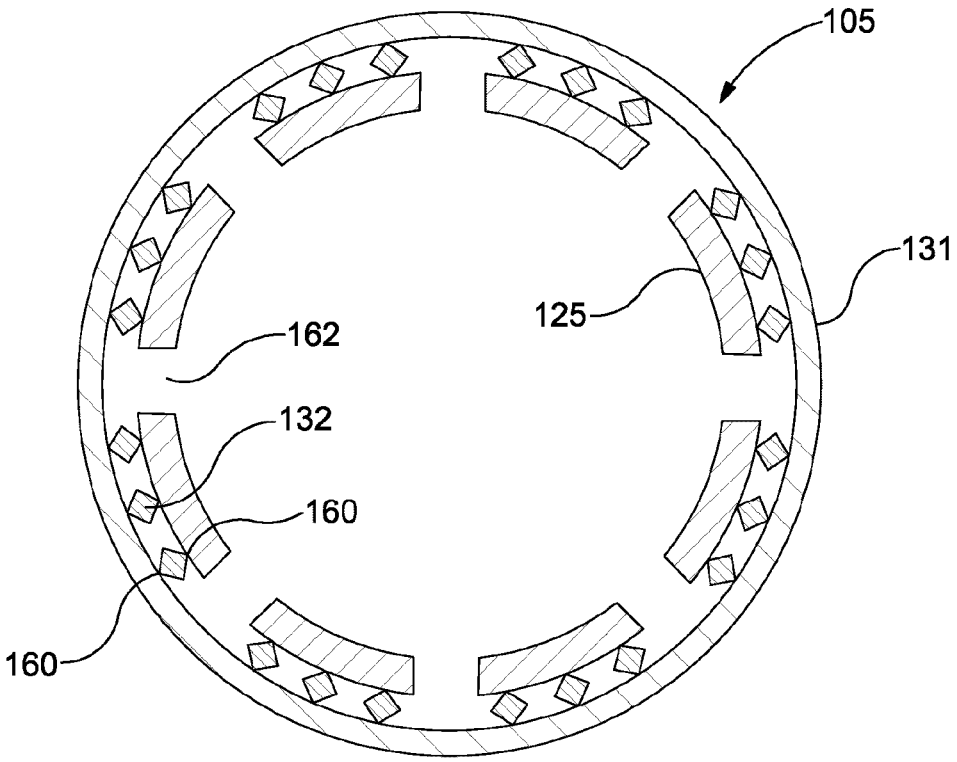
FIG. 4 is a transverse cross-sectional view of a screen according to an embodiment of the present invention.

Referring now to FIG. 4, there is shown a screen or screen assembly 105, such as a downhole/sand screen or screen assembly, comprising a pipe 125 and a sleeve 131 and at least one support 132 provided between the pipe 125 and the sleeve 131, wherein the at least one support 132 has a cross-section comprising first and second points or vertices or surface discontinuities or corners 160. Such support shape can provide enhanced erosion resistance.

The pipe 125 can be referred to as a base pipe or production pipe or tubing. The pipe is perforated and comprises a plurality of ports 162. The first and second points, vertices, surface discontinuities or corners 160 (hereinafter 'points') comprise a pair of points 160. The first and second points 160 face in substantially opposing directions along a radius or radial direction.

The at least one support 132 comprises a plurality of supports 132, i.e. axial supports and/or support rods. The supports 132 are disposed in an annular space between the pipe 125 and the sleeve 131.

In one implementation (shown in FIG. 4) the/each support 132 has a cross-section comprising a polygon having at least four sides, parallelogram, rectilinear, square or diamond shape.

Figure 5:
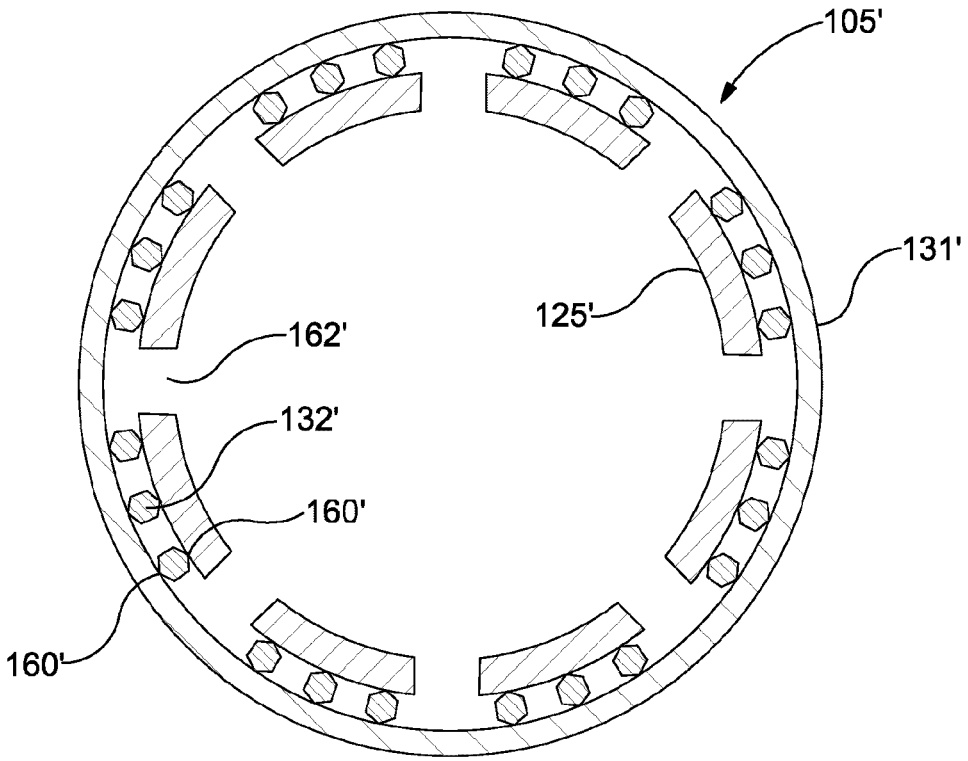
FIG. 5 is a transverse cross-sectional view of a screen according to an embodiment of the present invention.

In another implementation (shown in FIG. 5) the/each support 132' has a cross-section comprising a polygon having six sides, i.e. a polygon having opposing triangular end portions and a rectilinear or square mid-portion.

A first point 160; 160' is welded to the pipe 125; 125', i.e. an outer surface of the pipe. A second point 160; 160'; 132; 132' is welded to the sleeve 131; 131' i.e. an inner surface of the sleeve 131.

The support(s) is/are typically made from steel.

Figure 6:
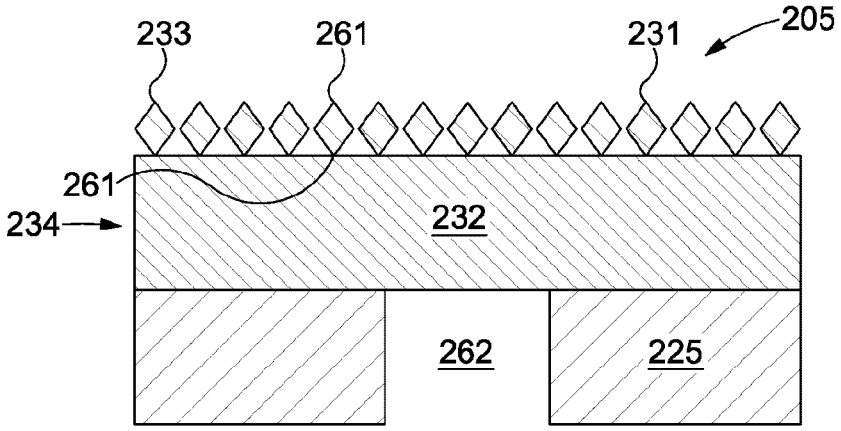
FIG. 6 is a partial longitudinal cross-sectional view of a screen according to an embodiment of the present invention.

Referring next to FIG. 6, there is shown a screen or screen assembly 205, such as a downhole/sand screen or screen assembly, comprising wire 233 having a cross-section comprising first and second points or vertices or surface discontinuities or corners 261. Such wire shape can provide enhanced erosion resistance.

The first and second points, vertices, surface discontinuities or corners 261 (hereinafter 'points') comprise a pair of points 261. The first and second points 261 face in substantially opposing directions, e.g. along a radius or radial direction.

The screen 205 comprises a pipe 225 and a sleeve 231 (the sleeve 231 comprising the wire 233/screen), and at least one support 232. The pipe 225 can be referred to as a base pipe or production tubing. The at least one support 232 comprises a plurality 232 of supports, e.g. axial supports and/or support rods. The supports 232 are disposed in an annular space 234 between the pipe 225 and the sleeve 231.

In one implementation (shown in FIG. 6) the/each wire 233 has a cross-section comprising a polygon having at least four sides or diamond shape.

In another implementation (shown in FIG. 7) the/each wire 233' has a cross-section comprising a polygon having six sides, e.g. a polygon having opposing triangular end portions and a rectilinear or square mid-portion.

A first point 261; 261' is welded to a support 232; 232', e.g. an outer surface of the support 232; 232'. A second point 261; 261' faces radially out, e.g. towards a formation or inner facing surface of a well-bore.

The wire 233; 233' is typically made from steel.

Referring next to FIGS. 8(*a*)-(*b*) there is shown a screen or screen assembly 305, such as a downhole/sand screen or screen assembly, wherein the screen 305 comprises wire 333 having a cross-section comprising a rectilinear or square shape. Such wire shape can provide enhanced erosion resistance.

The rectilinear shape comprises a rectangle or in this preferred implementation comprises a square. The wire 333 is disposed such that a line of symmetry of the rectilinear shape is provided along a radial direction of the screen 305 or pipe 325.

The screen 305 comprises a pipe 325 and a sleeve 331 (the sleeve comprising the wire/screen), and at least one support 332. A side of the wire 333 is welded to the support(s) 332.

Referring next to FIG. 8(*c*) there is shown a screen or screen assembly 305', such as a downhole/sand screen or screen assembly. The screen 305' is similar to the screen 305, like ports being identified by like numerals but suffixed '''.

Referring next to FIG. 8(*d*) there is shown a screen or screen assembly 305", such as a downhole/sand screen or assembly. The screen 305" is similar to the screen 305; 305' like ports being identified by like numerals, but suffixed '''''. In the screen 305" of FIG. 8(*d*) the pipe 325 comprise a tubular having a solid wall, i.e. which is not perforated.

Where wrap wires 333; 333'; 333" of a square cross-section are used to construct the filter media the smooth passage created under such will reduce turbulence and tend flow to continue longitudinally. This can promote a more even distribution of injection fluid through the wire wrap 333; 333'; 333".

The construction of the filter media can be used in situations where the base pipe is perforated (shown in FIGS. 8(*a*)-(*b*) and FIG. 8(*c*)) or where the base pipe is imperforated (shown in FIG. 8(*d*)) and flow enters the annulus between the base pipe and the wrap wires at a point lower down the sand screen joint.

It will be appreciated any combination of shape of wire (wire wrap) and/or support is possible, e.g. wire and/or supports selected from triangular, diamond shape, hexagonal, elongate hexagonal, square or rectangular cross-sectional shape (though not both triangular). It will be appreciated that any such combination of wire and support shape may provide enhanced erosion resistance in at least one of injection and production.

Figure 7:
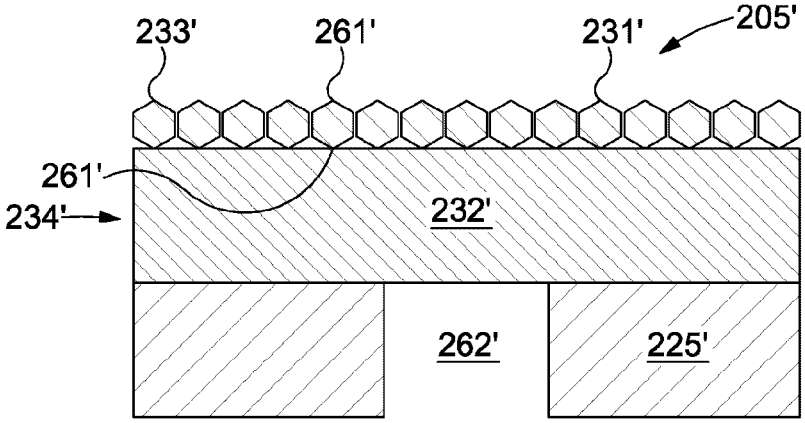
FIG. 7 is a partial longitudinal cross-sectional view of a screen according to an embodiment of the present invention.
Figure 8A:
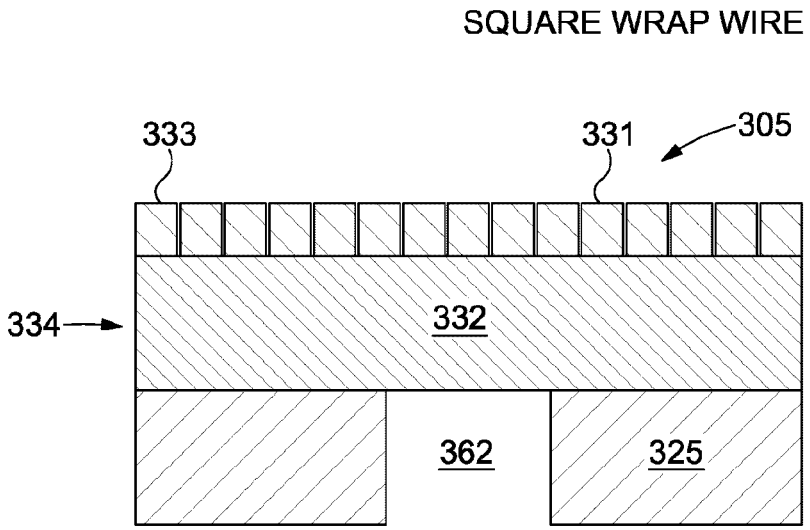
FIGS. 8(*a*)-(*b*) are partial longitudinal cross-sectional views of a screen according to an embodiment of the present invention.
Figure 8B:
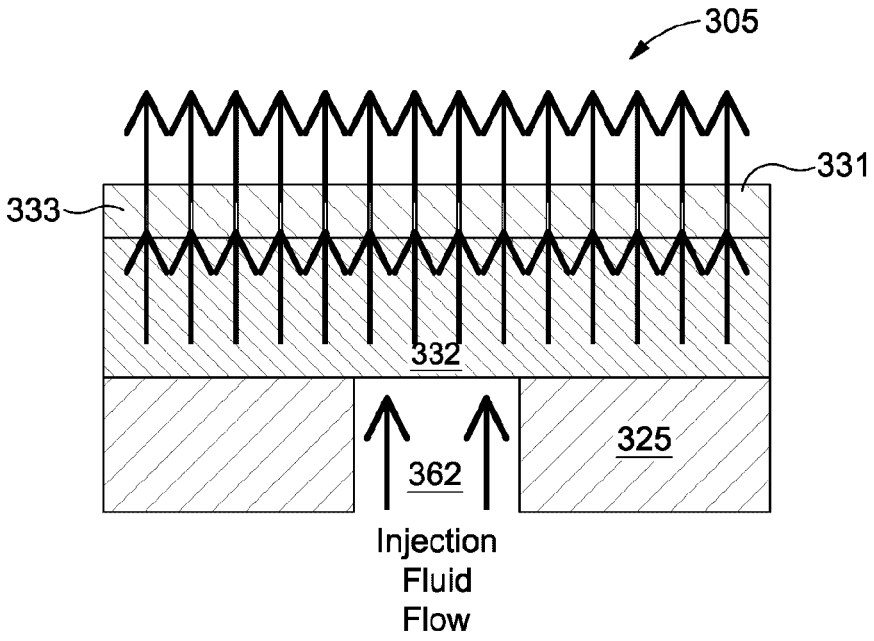
Figure 8C:
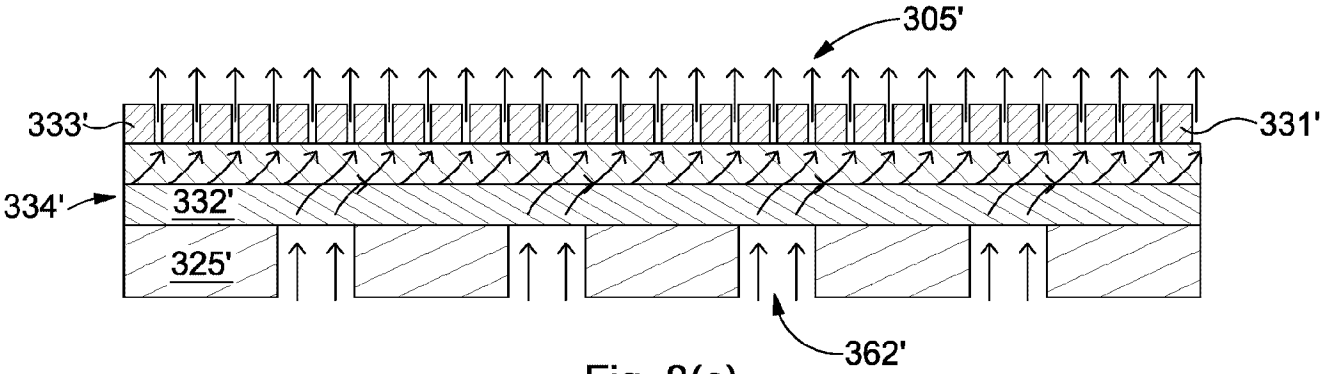
Figure 8D:
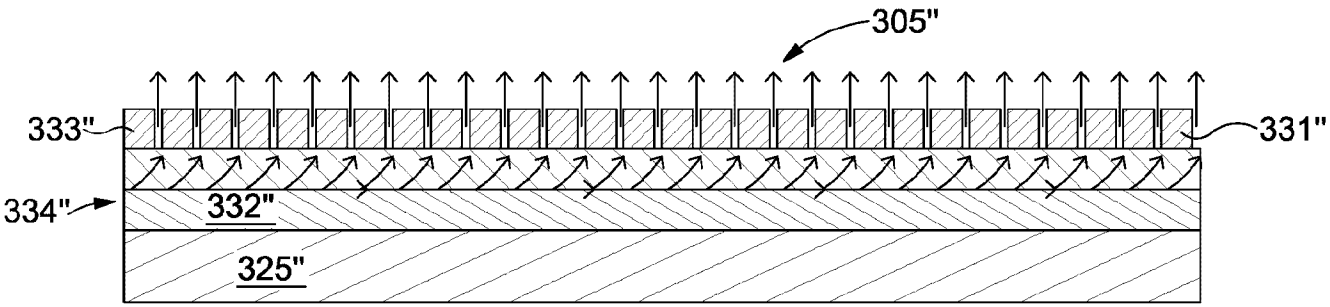
Figure 9B:
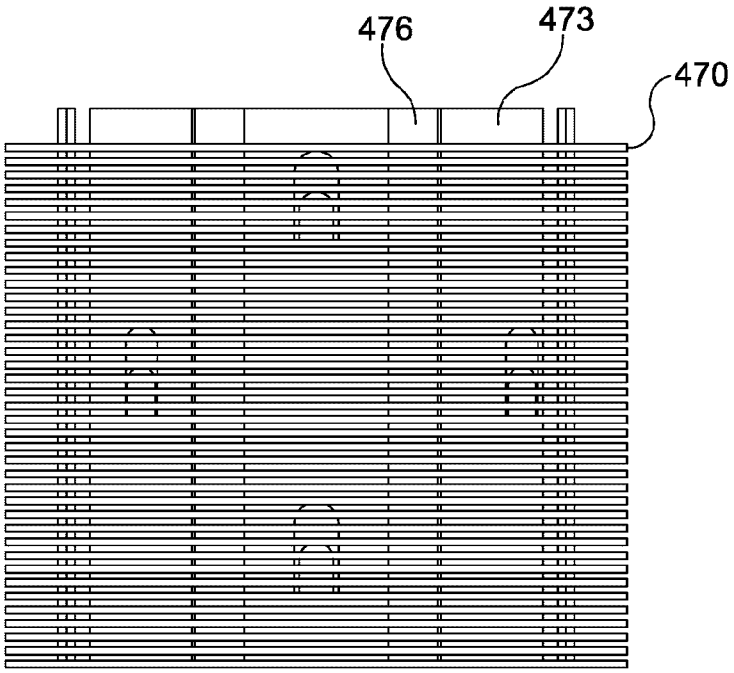
FIG. 9(*a*) is a transverse cross-sectional view of a screen according to an embodiment of the present invention.
Figure 9A:
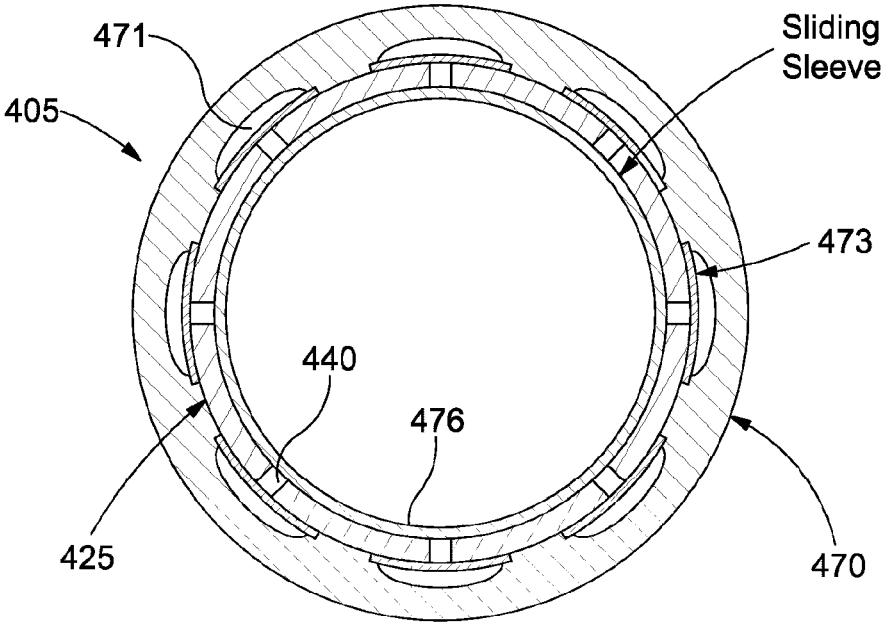
Figure 9C:
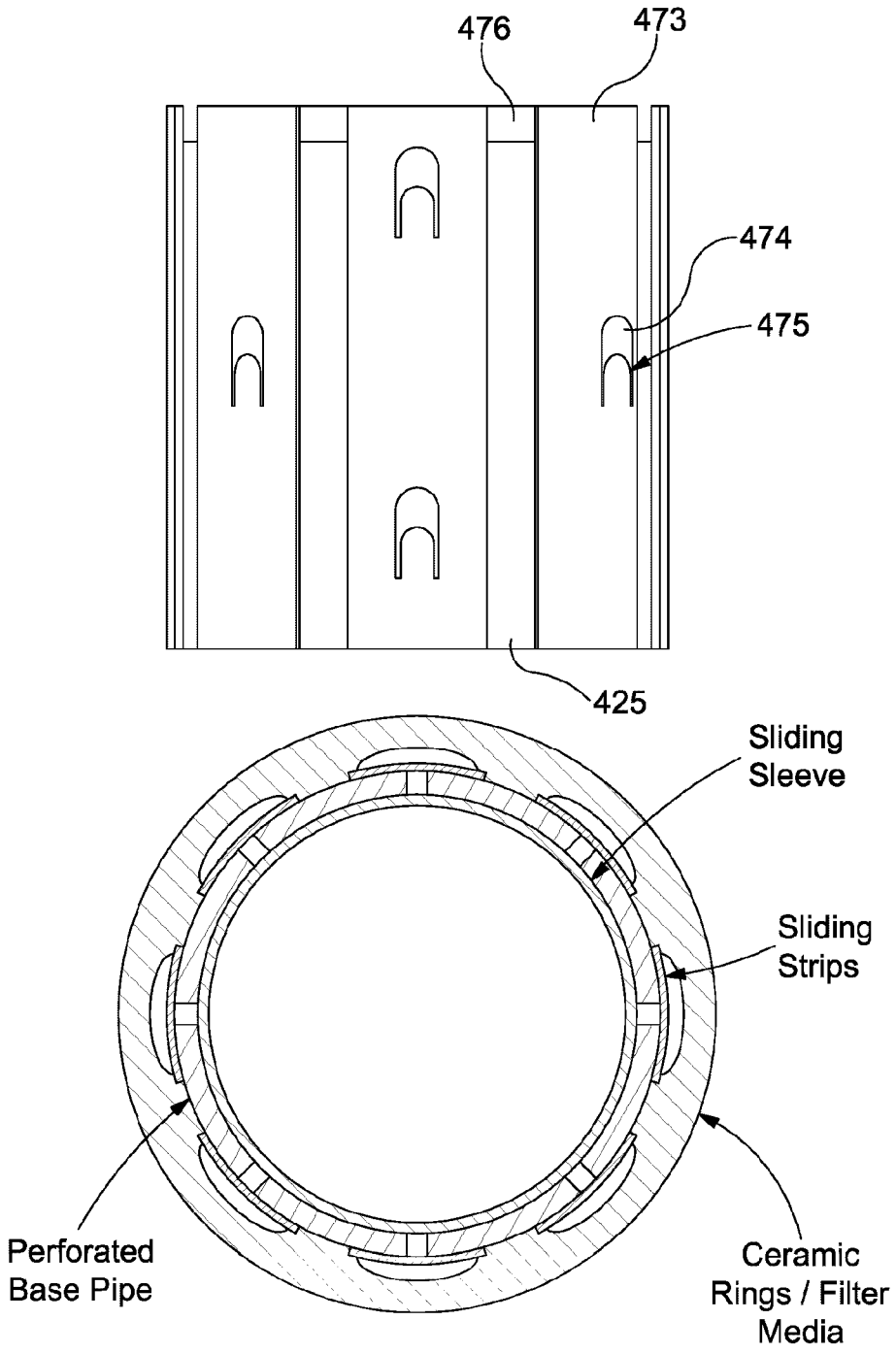
Figure 9D:
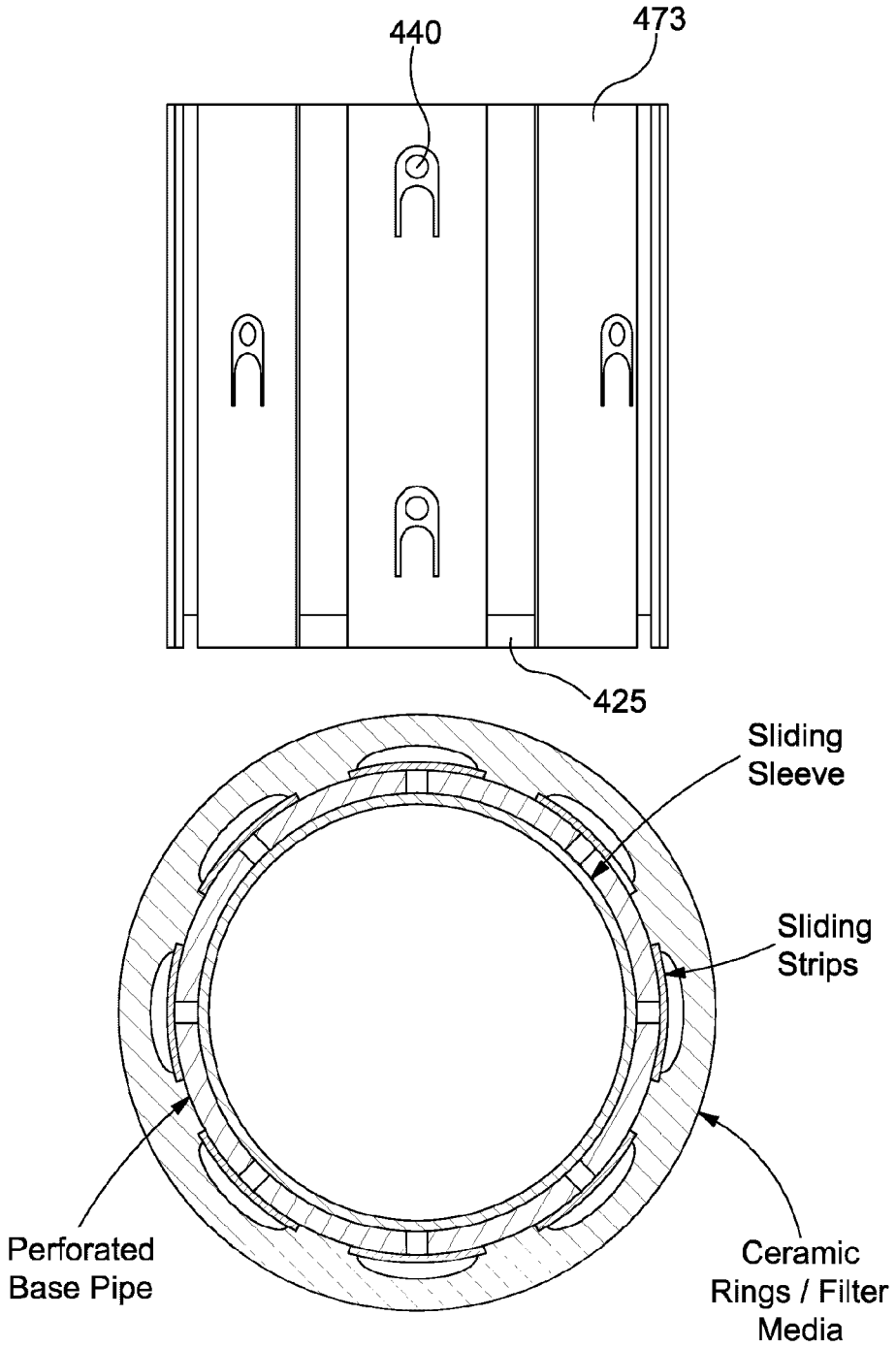
Figure 9E:
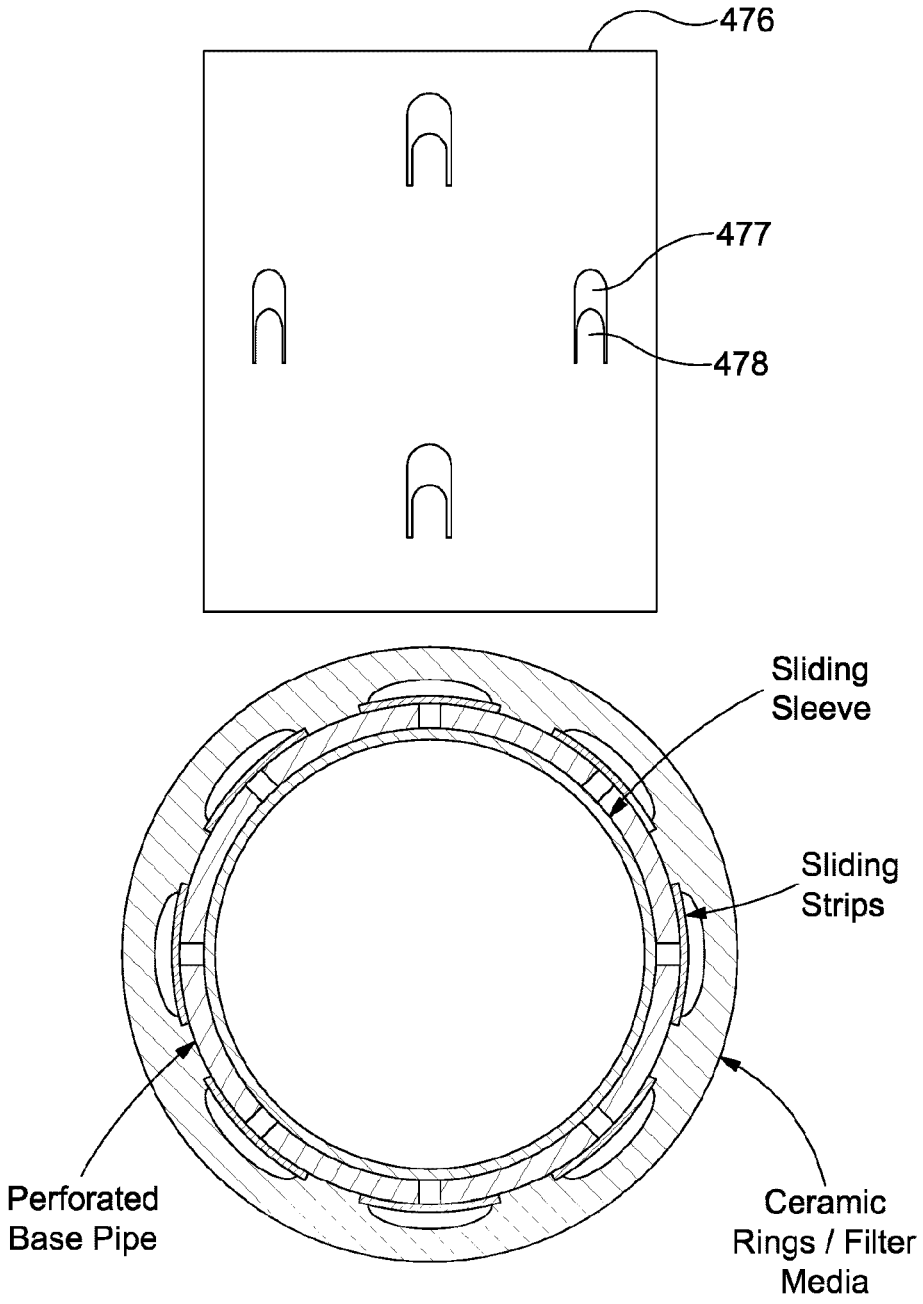

Regarding the wire of the screen or screen assembly of FIG. 6, FIG. 7, FIG. 8(*a*)-(*b*), FIG. 8(*c*) or FIG. 8(*d*), or indeed FIGS. 3(*a*)-(*c*), the wire comprises coated and/or hardened wire 233; 233'; 333; 333'; 333"; 333*c*. The wire can beneficially be made from steel.

The screen comprises a pipe and a sleeve, the sleeve comprising the wire, and optionally at least one support.

In one implementation the coating is tungsten carbide, e.g. hardide tungsten carbide. The coating is applied or deposited by chemical vapour deposition (CVD), which can be applied to steel. The wire can be heat treated so as to harden.

The wire can be provided in coated and/or hardened lengths and made-up or assembled in longer lengths so as to provide the sleeve.

Figure 14A:
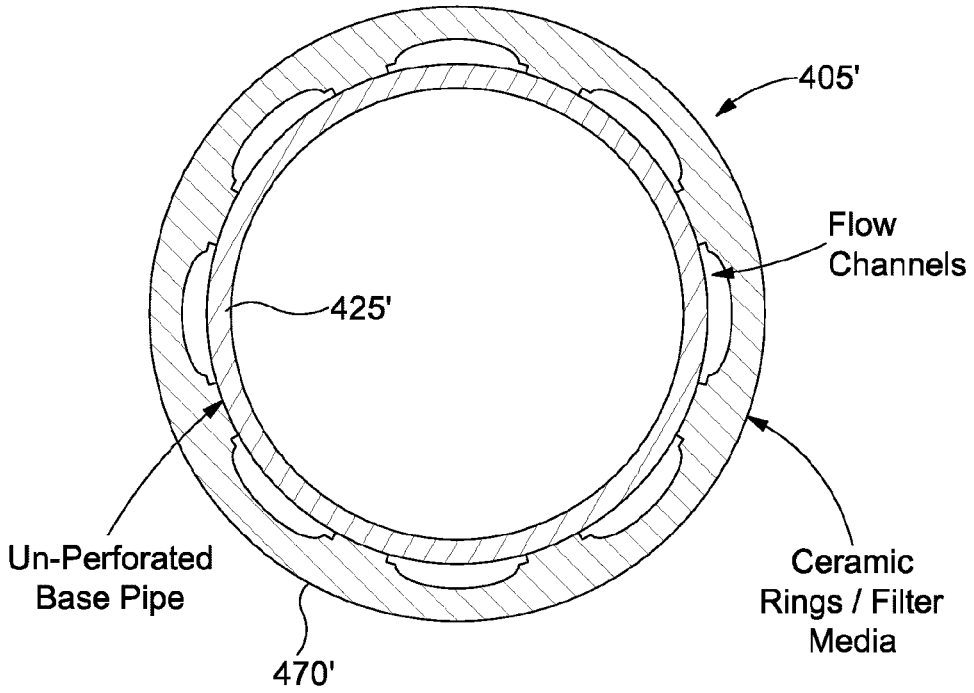
FIG. 14(*a*) is a transverse cross-sectional view of a screen according to an embodiment of the present invention.
Figure 14B:
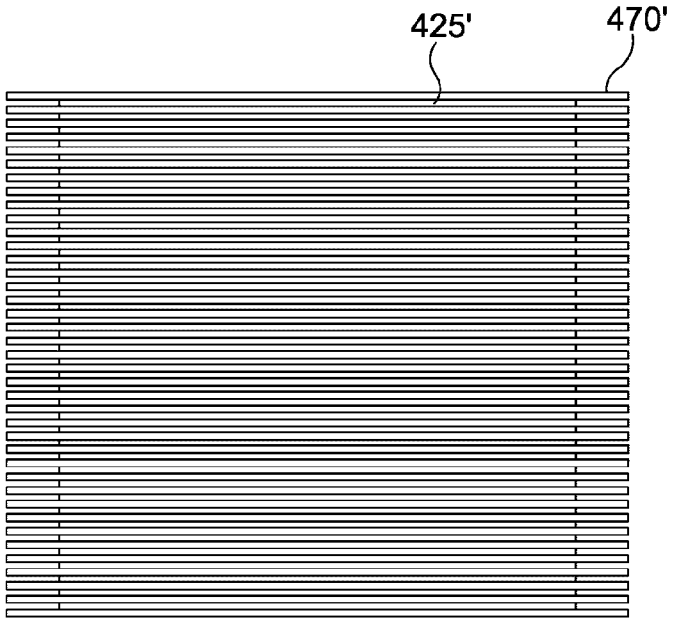
Figure 15A:
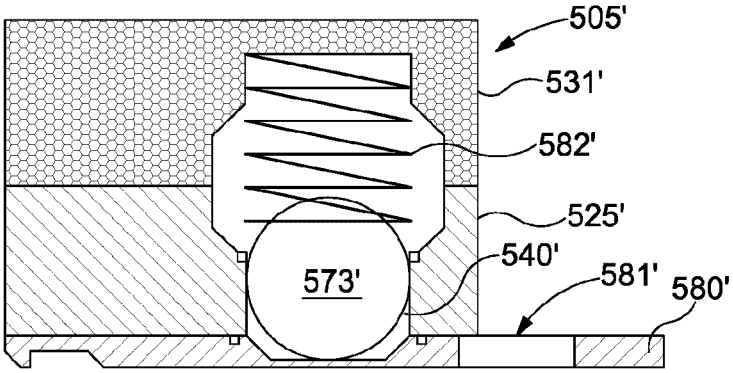
FIGS. 15(*a*)-(*c*) are a series of longitudinal cross-sectional views of a screen according to an embodiment of the present invention.
Figure 15B:
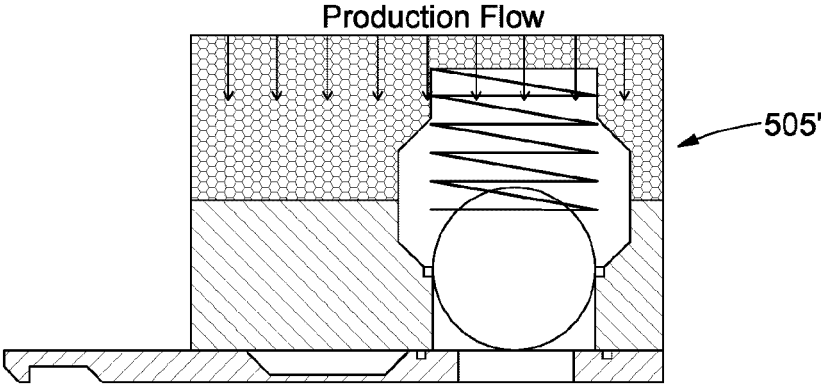
Figure 15C:
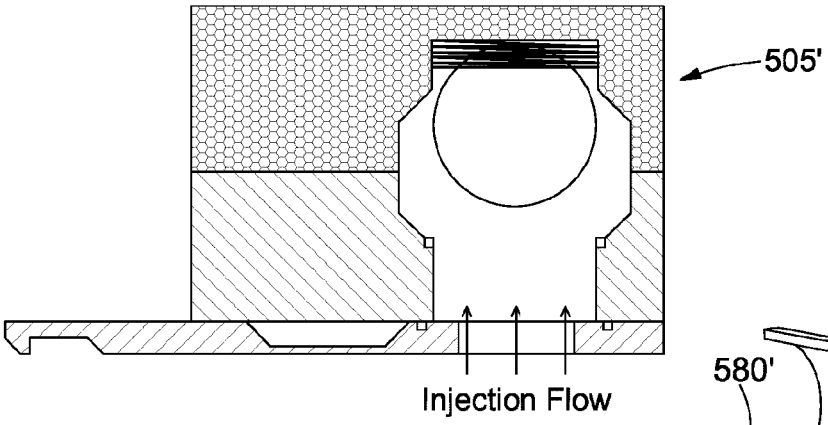
Figure 15D:
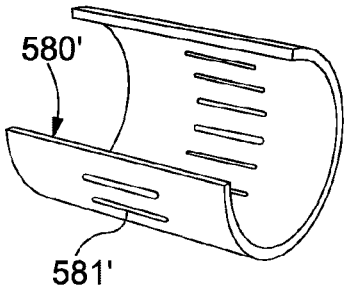
Figure 16C:
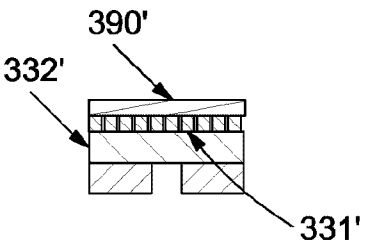
FIG. 16(*a*) is a transverse cross-sectional view of screen according to an embodiment of the present invention.
Figure 16B:
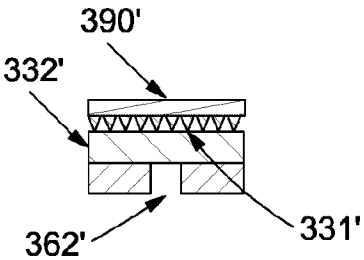
Figure 16D:
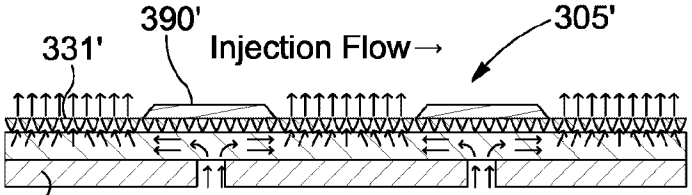
Figure 16A:
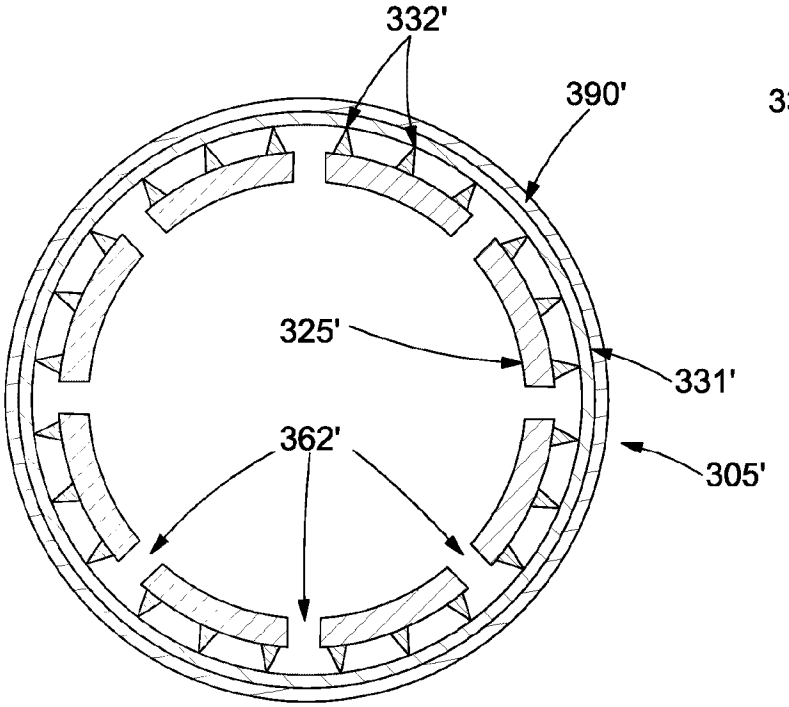

Referring next to FIGS. 9(*a*)-(*e*) and FIG. 14(*a*)-(*b*) there is shown a screen or screen assembly 405; 405', such as a downhole or sand screen or screen assembly, comprising a pipe 425; 425' and a plurality of ceramic discs 470; 470' around the pipe 425; 425'. High hardness of the ceramic provides enhanced erosion resistance.

The ceramic discs 470; 470' are stacked on each other. Gaps between the discs 470; 470' determine a size of particulate to be filtered, and can be modified to suit a well and a specification of an operator.

The pipe 425 can be referred to as a base pipe or production tubing. In one implementation (see FIGS. 9(*a*)-(*e*)) the pipe 425 is perforated and/or comprises a plurality of ports 440. The pipe 425 is slotted. In another implementation (see FIGS. 14(*a*) and (*b*)) the pipe 425' is non-permeable or solid.

The pipe 425 comprises a plurality of ports 440, e.g. slots, e.g. circumferentially and axially spaced thereupon.

One or more of the discs 470; 470' are arranged so as to provide circumferential/annular spaces 471; 471' between the pipe 425; 425' and the respective disc 470; 470'.

Between adjacent circumferential/annular spaces 471; 471' the disc(s) 470; 470' are arranged such that there is no gap between the pipe 425; 425' and the disc 470; 470'. Such arrangement is provided by portions of the disc 470; 470' having reduced internal diameter, i.e. such that the pipe 425; 425' and the disc(s) 470; 470' radially abut or contact one another at said portions.

The space(s) 471; 471' extend longitudinally between adjacent discs 470; 470'. The space(s) 420; 420' are aligned, i.e. rotationally aligned, with at least one port 440 in the pipe 425; 425'.

A valve member 473 is provided between a port 440 and a respective space 471. The/each valve member 473 comprises a slidable member, i.e. longitudinally slidable member. Each valve member 473 comprises at least one further port 474 and/or at least one reed valve 475, which is/are (longitudinally) selectively alignable with or out of alignment with a port 440 of the pipe 425.

The screen or screen assembly also comprises an inner sleeve 476 (see FIG. 9(*a*)). The inner sleeve 476 is slidable relative to the pipe 425. An outer surface of the inner sleeve 476 abuts or contacts an inner surface of the pipe 425.

The inner sleeve 476 comprises at least one yet further port 477 and/or further reed valve 478, which is/are (longitudinally) selectively alignable with or out of alignment with a port 440 of the pipe 425.

Referring to FIGS. 14(*a*)-(*b*), there is shown a screen or screen assembly 405, such as a downhole screen or screen assembly, comprising a pipe 425' and/or sleeve comprising discs 470', wherein the pipe comprises a solid or non-perforated pipe 425'. Such arrangement can provide enhanced erosion resistance. The solid or non-perforated pipe 425' can comprise or be provided with an opening(s) or port(s) at or adjacent an end(s) thereof, e.g. to deliver injection fluid to a formation.

Figure 10A:
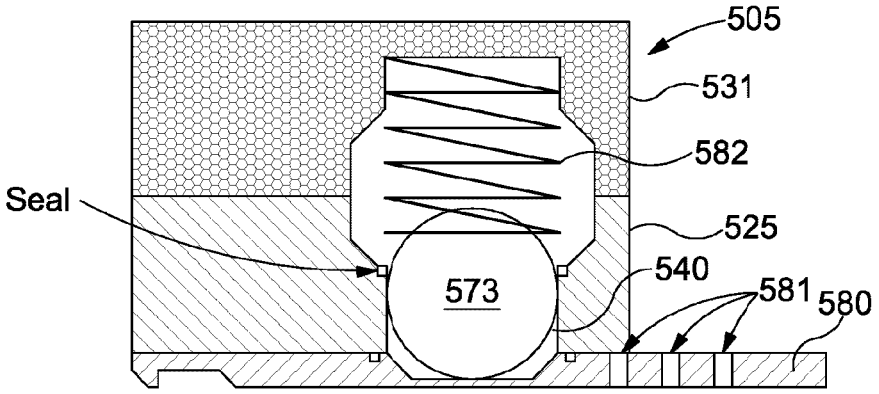
FIGS. 10(*a*)-(*c*) are a series of longitudinal cross-sectional views of a screen according to an embodiment of the present invention.
Figure 10B:
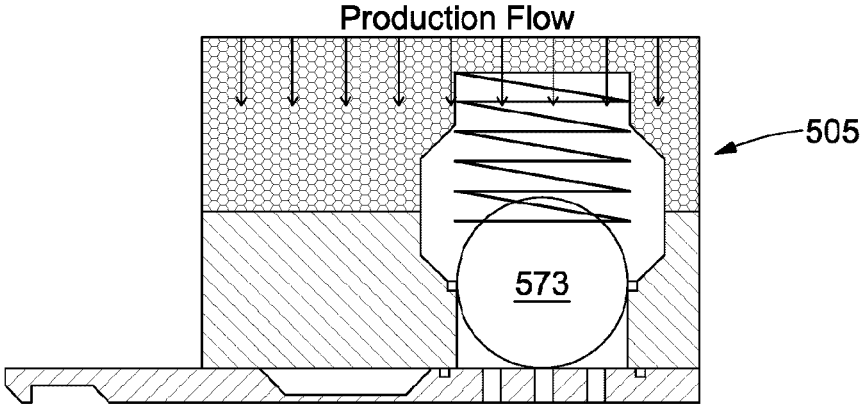
Figure 10C:
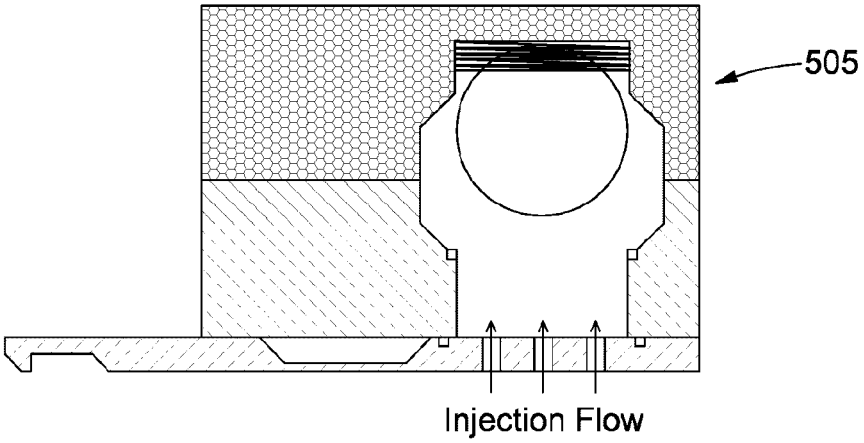

Referring to FIGS. 10(*a*)-(*c*) there is shown a screen or screen assembly 505, such as a downhole/sand screen or screen assembly, comprising a pipe 525 and a sleeve 531, wherein the pipe 525 comprises openings or slots (e.g. longitudinally or axially opening(s) or slot(s)) 540 and the sleeve 531 comprises a foam or microporous material the sleeve 531 being bonded with or to an exterior surface of the pipe. Such arrangement can provide enhanced erosion resistance. Such arrangement can provide relatively even distribution of injection fluids.

The pipe can be referred to as a base pipe or production tubing. The openings or slots can comprise daisy passages. The opening or slots, in use, fluidically communicate with the sleeve.

Referring to FIGS. 15(*a*)-(*d*), there is shown a screen or screen assembly 505', such as a downhole/sand screen or screen assembly, comprising a pipe 525' and a microporous sleeve 531', wherein the pipe 525' comprises a plurality of slotted ports 540' or longitudinally extending ports 540'. Such arrangement can provide enhanced erosion resistance, and operates in a similar manner to the screen of FIGS. 10(*a*)-(*c*).

The following optional features apply to any disclosed embodiments.

The pipe is typically referred to as base pipe or production tubing.

Where provided the microporous sleeve 531; 531' can be an erosion resistant microporous sleeve. The microporous sleeve 531; 531' comprises a material selected from a metal foam or a ceramic foam. The microporous sleeve 531; 531' comprises a material selected from the group consisting of microporous polymeric foams, microporous metal foams, microporous carbide monoliths, in particular, silicon carbide, tungsten carbide, or titanium carbide monoliths or microporous nitride monoliths, such as boron nitride. The microporous sleeve 531; 531' intimately contacts and/or is bonded to an outer surface of the pipe 525; 525'.

Figure 11A:
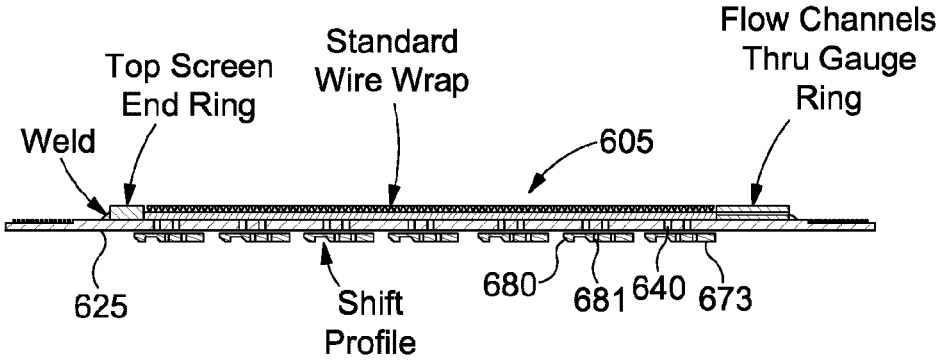
FIG. 11(*a*) is a partial longitudinal cross-sectional view of a screen according to an embodiment of the present invention in a closed position.
Figure 11B:
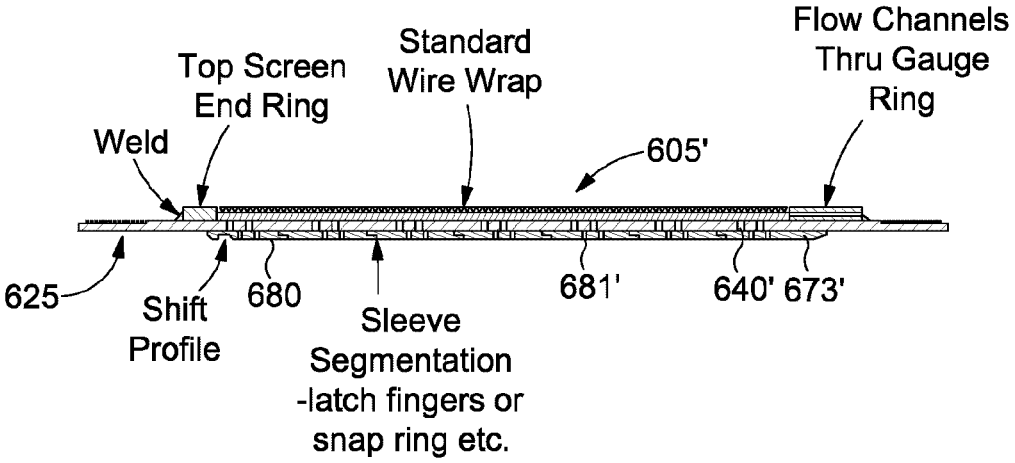
Figure 12A:
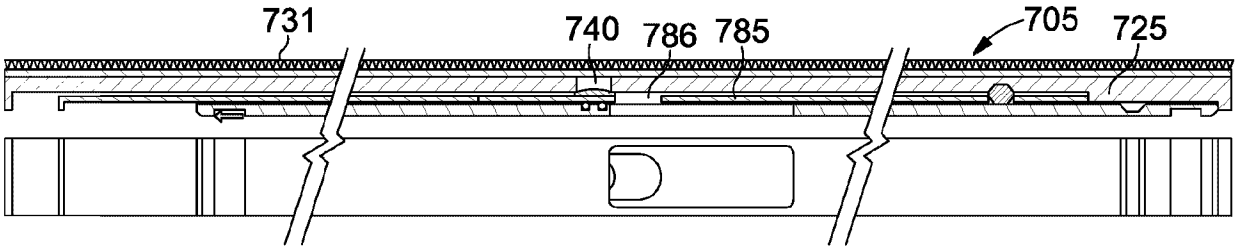
FIGS. 12(*a*)-(*c*) are a sequence of longitudinal cross-sectional views illustrating opening of a screen according to an embodiment of the present invention.
Figure 12B:
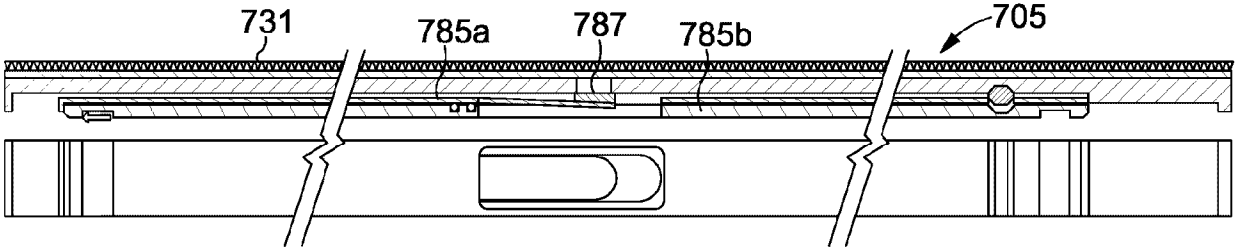
Figure 12C:
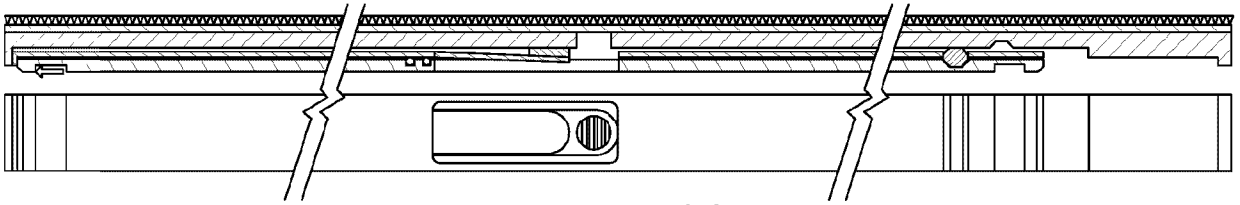
Figure 12D:
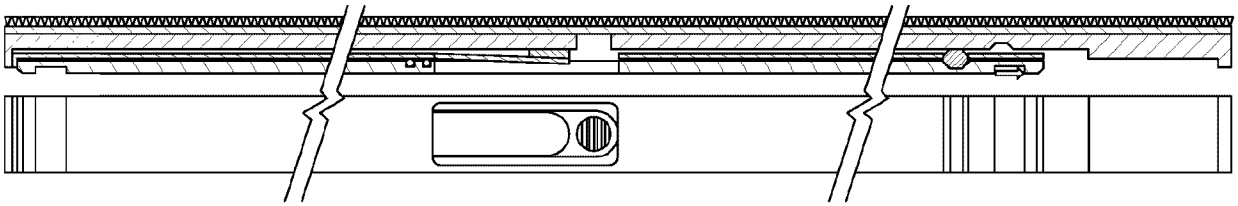
Figure 12E:
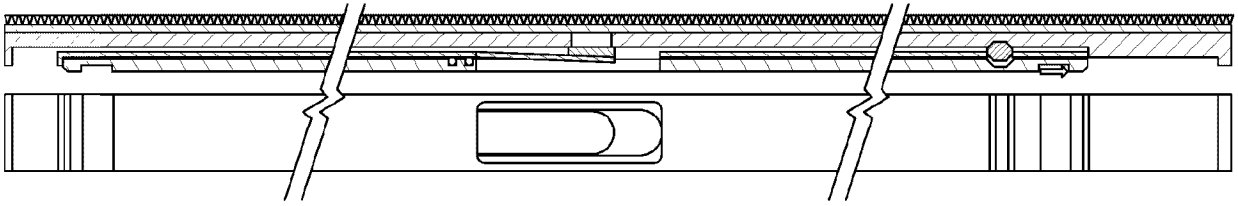
Figure 12F:
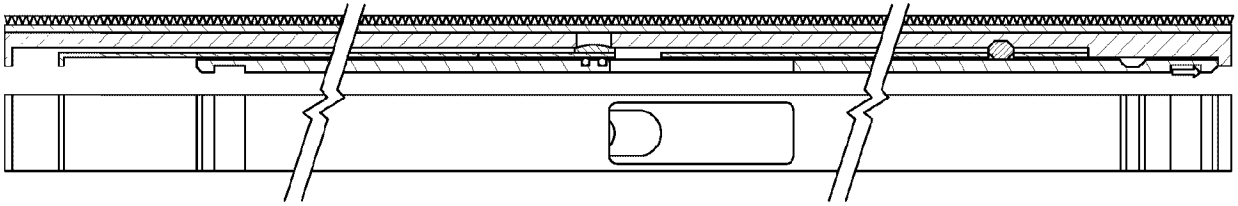
Figure 13A:
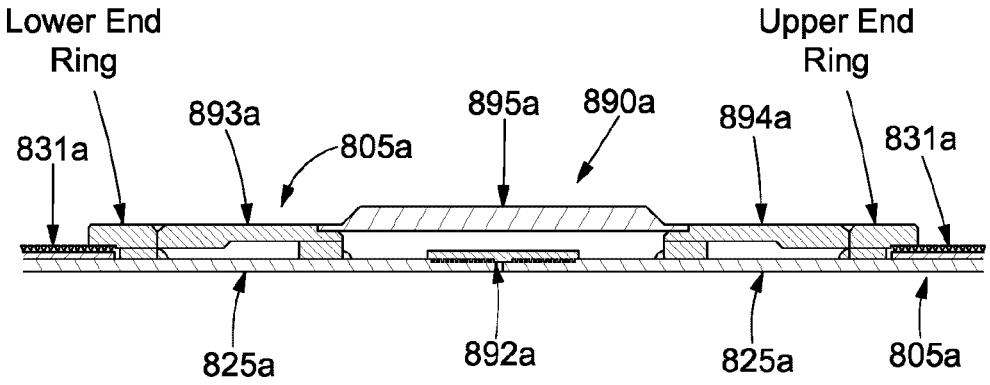
FIGS. 13(*a*)-(*b*) is longitudinal cross-sectional views of a screen assembly according to an embodiment of the present invention.
Figure 13B:
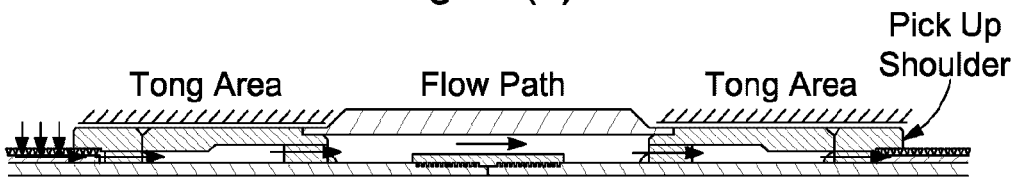
Figure 13C:
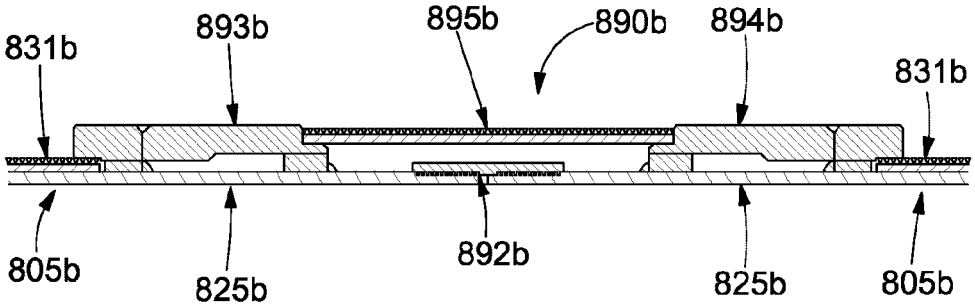
Figure 13D:
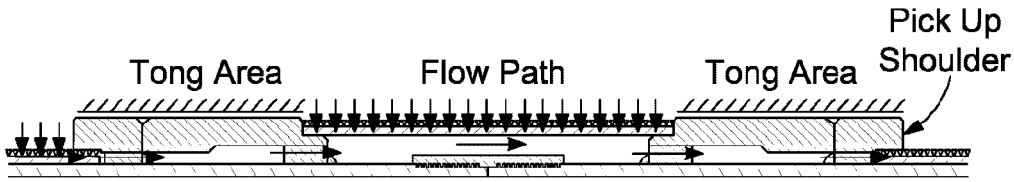

Referring now to FIGS. 9(*a*)-(*e*), FIGS. 10(*a*)-(*c*), FIG. 11(*a*) and FIGS. 15(*a*)-(*c*) there is shown screens or screen assemblies 405; 505; 605; 505', such as a downhole/sand screen or screen assembly, comprising a pipe 425; 525; 625; 525' having at least one port 440; 540; 640; 540' or perforation or hole, the/each port 440; 540; 640; 540' or perforation or hole having an associated valve 473; 573; 673; 573'.

The pipe 425; 525; 625; 525' can be referred to as a base pipe or production tubing. The/each valve 473; 573; 673; 673' can be a check valve.

The pipe 425; 525; 625; 625' comprises a plurality of ports 440; 540; 640; 640' or perforations, each port 440; 540; 640; 640' or perforation having an associated valve 473; 573; 673; 673'.

The/each valve 473; 573; 673; 673' is, in use, initially provided to isolate the inner diameter of the pipe 425; 525; 625; 525' from the outer diameter of the pipe 425; 525; 625; 525'. Upon opening the valve(s) 473; 573; 673; 573' the provision of multiple ports/perforations/holes in the pipe 425; 525; 625; 525' provides improved distribution of injection fluid. The/each valve 473; 573; 673; 573' comprises a valve member.

The/each valve member 573; 673; 573' is deployable by a sliding sleeve 580; 680; 580' and/or by pressure of fluid flow, in use.

The sliding sleeve 580; 680; 580' can slide relative to an inner surface of the pipe 525; 625; 525'. The sliding sleeve 580; 680; 580' comprises a port(s) 581; 681; 581' which is controllably aligned with ports 540; 640; 540' of the pipe 525; 625; 525'.

The valve member(s) 573; 673; 573' may be biased into a closed position, e.g. by biasing means 582; 682; 582'.

In one implementation (see FIGS. 10(*a*)-(*c*)) the valve member(s) 573 comprises a spherical member(s) or balls, e.g. biased spherical member(s). The/each spherical member or ball is provided, i.e. movably provided, within a space provided by a port in the pipe and a recessed portion in a sleeve.

Referring to FIG. 10(*d*), when run-in hole the balls are press-fitted within a hole(s) in the base pipe, as shown. The balls are supported by a sliding sleeve preventing differential pressure from an outside passing through the filter media and forcing them through the base pipe. Pressure is isolated between the outside and the inside of the base pipe via seals positioned on the outer diameter (OD) of a (long) sliding sleeve.

Referring to FIG. 10(*b*), when ready to open the sand screen up to flow, a short shift of the base pipe will cause the recessed area in the sliding sleeve to push the balls out of their respective holes in the base pipe; the new surface against which the balls rest prevents differential pressure from the outside passing through the filter media and pushing the balls back into the press fitted condition. Flow ports in the (long) sliding sleeve are now exposed below the balls and a seal in the port within the base pipe provides a pressure check preventing differential pressure from production flow passing into the sand screen. A (weak) spring excerpts (gentle) pressure on the ball allowing it to seal at low differential pressures.

Referring to FIG. 10(*c*), when subjected to injection flow the balls lift off of their respective seats and compress the (weak) spring allowing flow to pass into the filter media.

Referring to FIG. 11(*a*) in the screen 605, the perforated base pipe 625 can be sealed off by a number of sliding sleeves 680. These can all be locked in place (opened and closed) by means of latch fingers. Each sleeve 680 has a shift profile with a kick-down shoulder on the rear of the sleeve 680 above it, meaning that as the sift tool can be pulled through, the shift tool pulls open the sleeve and auto-out from the above kick-down shoulder whereupon it latches into the next profile and opens that, and so on.

Referring to FIG. 11(*b*) there is shown a screen or screen assembly 605', similar to the screen 605 of FIG. 11(*a*), like ports being identified by the numerals but suffixed "'".

In the screen 605', the topmost sleeve 680' has a shifting pole. The rest of the sleeves 680' are closely linked so that they all open at the same time, but are segmented to account for concentricity, friction, bends etc.

In another implementation the valve member(s) comprise a flap, i.e. thin metallic or steel flap, or reed valve.

Referring next to FIGS. 12(*a*)-(*f*) there is shown a screen or screen assembly 705, such as a downhole/sand screen or screen assembly, comprising a pipe 725 having at least one port or perforation or hole 740, and a sleeve 785 provided within the pipe 725, the sleeve 785 having at least one respective port or perforation or hole 786 which in a closed position is not aligned or is misaligned with the at least one port or perforation or hole 740 in or on the pipe 725 but which in an open position is alignable or aligned with the at least one port or perforation or hole 740 in or on the pipe 725. The pipe 725 can be referred to as a base pipe or production tubing.

The sleeve 785 (internal sleeve) comprises a shift sleeve. The sleeve 785 is slidable relative to the pipe 725 so as to move from a closed to open position and optionally vice versa.

The pipe 725 comprises a plurality of ports or perforations or holes 740. The/each sleeve 785 (internal sleeve) comprises a plurality of respective ports or perforations or holes 786. The presence of multiple ports/perforations/holes allows for improved distribution of injection fluid. The screen 705 comprises an (outer) screen sleeve 731, e.g. comprising wire.

Referring again to FIGS. 12(*a*)-(*f*) there is shown a screen or screen assembly 705, such as a downhole/sand screen or screen assembly, comprising a pipe 725, and a plurality of inner sliding sleeves 785*a*; 785*b* provided within the pipe 725.

The pipe 725 can be referred to as a base pipe or production tubing.

The sleeves 785*a*, 785*b* are provided within the pipe 725. The sleeves 785*a*, 785*b* each comprise a sliding/shift sleeve. There are provided first and second sleeves 785*a*; 785*b*, one within the other.

Movement, i.e. sequential movement of the sleeves, causes alignment or misalignment, of ports in the pipe 725 and the sleeve(s) 785*a*; 785*b*, e.g. opening or closing, of the screen. Sliding movement of a first sleeve 785*a* causes sliding movement of a second sleeve 785*b*, i.e. to open the screen 705. Sliding movement of a second sleeve 785*b* causes sliding movement of a first sleeve 785*a*, i.e. to close the screen 705.

Referring yet again to FIGS. 12(*a*)-(*f*) there is shown a screen or screen assembly 705, such as a downhole/sand screen or screen assembly, comprising a pipe 725 comprising at least one port/perforation/hole 740, the or each port 740 having a respective seal 787.

The pipe 725 can be referred to as a base pipe or production tubing. The pipe 725 comprises a plurality of ports 740.

In a closed disposition the respective plug 787 is received or be provided within or adjacent to the respective port 740. In an open disposition the respective plug 787 is provided distal the respective port 740. The plug(s) 787 are carried by a sleeve 785*a*, i.e. on an outer surface of a shifting/sliding sleeve provided within the pipe 725.

Figures 17A, 17B, 17C:
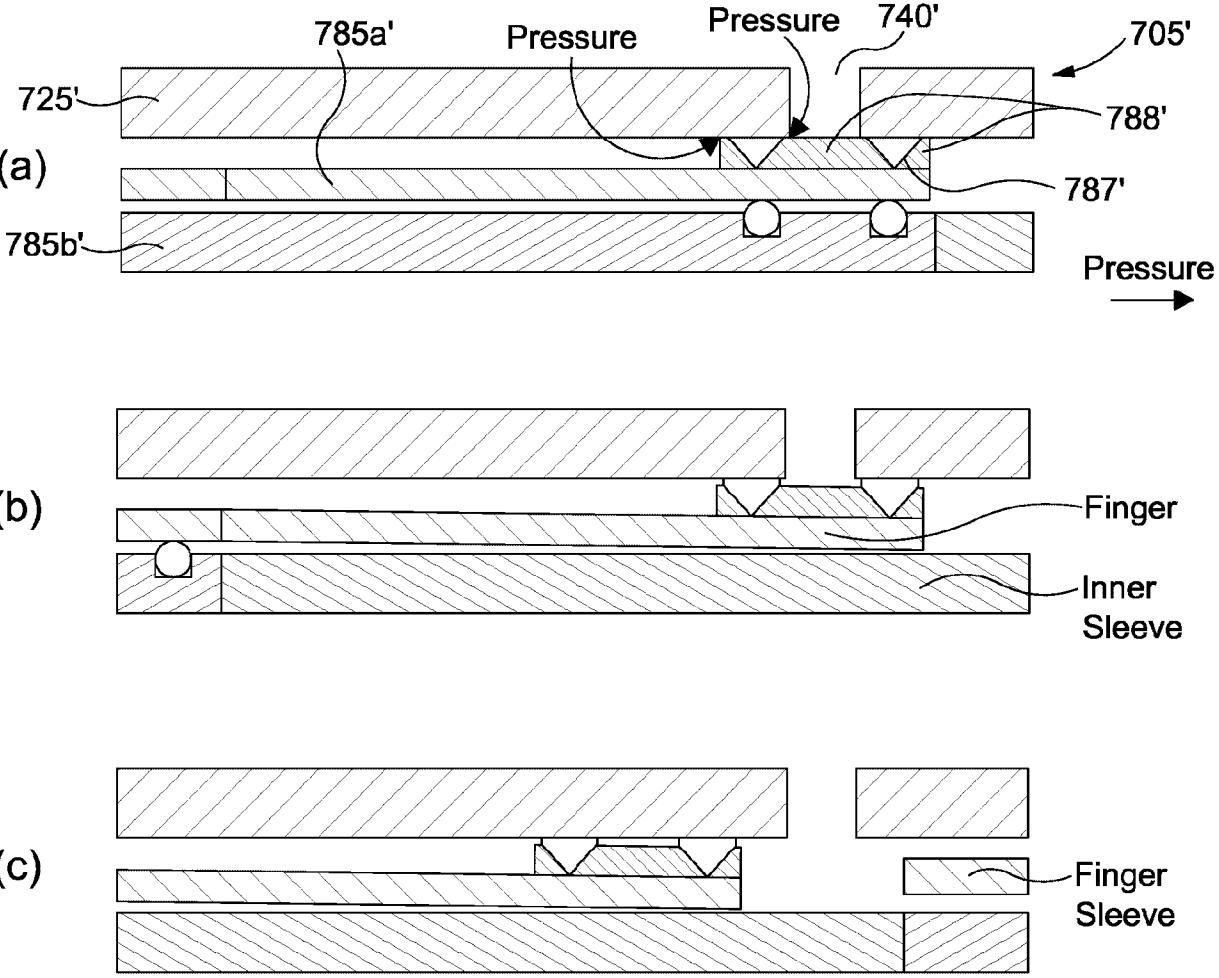
FIGS. 17(*a*)-(*c*) are a sequence of longitudinal cross-sectional views illustrating opening of a screen according to an embodiment of the present invention.

Referring to FIGS. 17(*a*)-(*c*) there is shown a modification to the screen 708 of FIGS. 12(*a*)-(*f*). In the modified screen 708' shown in FIGS. 17(*a*)-(*c*) like parts are identified by like numerals but suffixed "'".

In the screen 708' the seal 787' has plastic back-ups 788'.

Referring to FIG. 17(*a*), with the seal 787' in place, the seal 787' is compressed against the hole 740' in the base pipe 725'. A pressure differential from either direction will energise the seal 787' and act to ensure pressure integrity. Referring to FIG. 17(*b*), sliding the inner sleeve 785*b*' de-supports the finger sleeve 785*a*' and relaxes compression in the seal 787'. Referring to FIG. 17(*c*), the finger sleeve 785' can now be slid to expose the hole 740'.

According to the present invention there is also provided a screen assembly, such as a downhole/sand screen assembly, comprising a first screen 105; 205; 305; 305'; 305"; 405; 505; 605; 705; 405'; 505' 705' according to any preceding embodiment of the present invention and a second screen 5*c*.

The first screen 705 and second screen 5*c* are longitudinally disposed relative to one another. The first screen can be selected to be provided in high(er) flow areas, i.e. production and/or particularly injection fluid flow areas. The second screen 5*c* can be selected to be provided in low(er) flow areas, i.e. production and/or injection fluid flow areas. The second screen can comprise wire having a cross-section comprising a triangular shape (see FIGS. 3(*a*)-(*c*)).

Figure 18A:
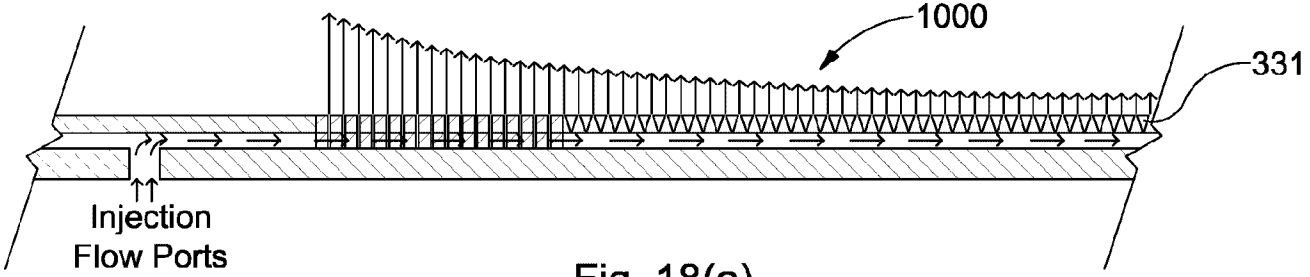
FIG. 18(*a*)-(*b*) partial longitudinal cross-sectional views of a screen assembly according to an embodiment of the present invention.
Figure 18B:
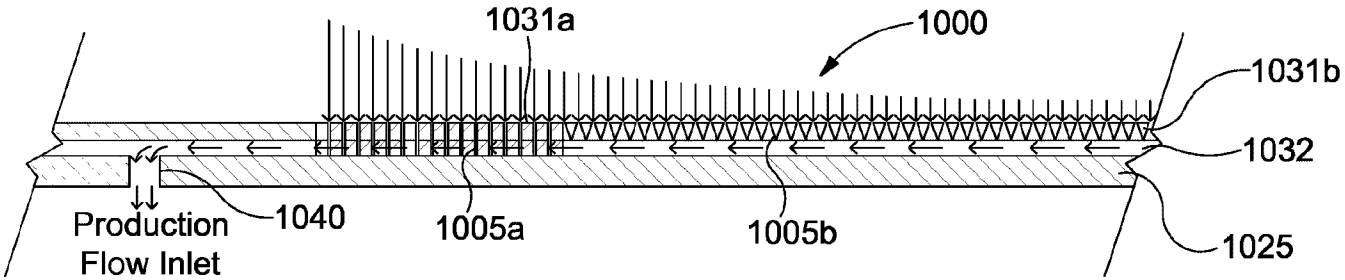
Figure 19A:
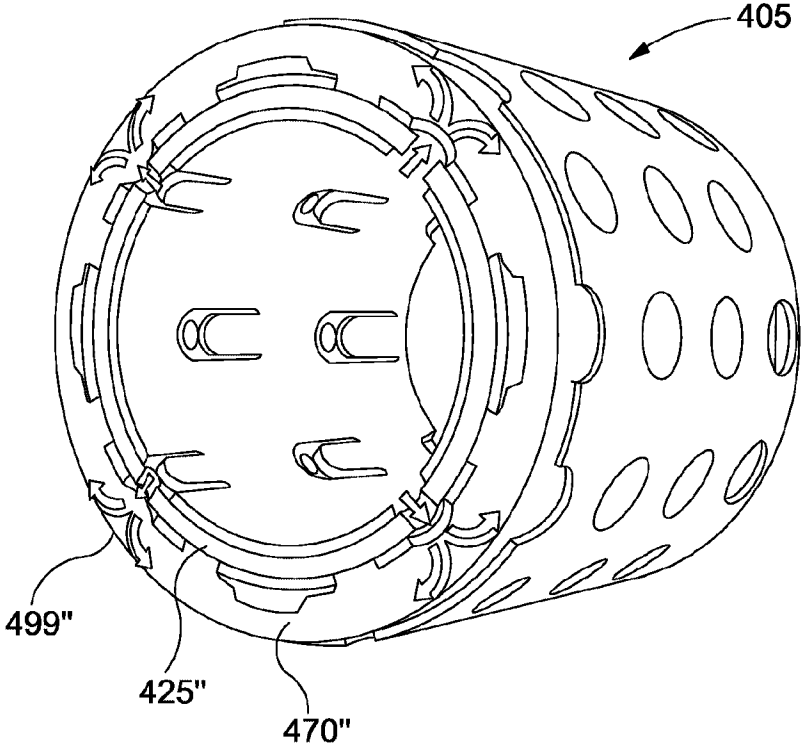
FIG. 19(*a*) is a perspective longitudinal view of a screen according to an embodiment of the present invention.
Figure 19B:
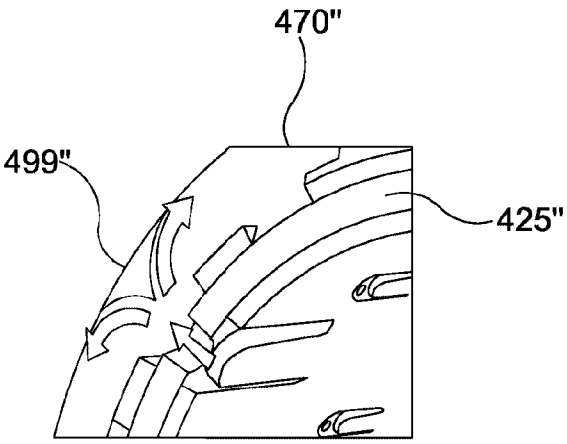
Figure 19C:
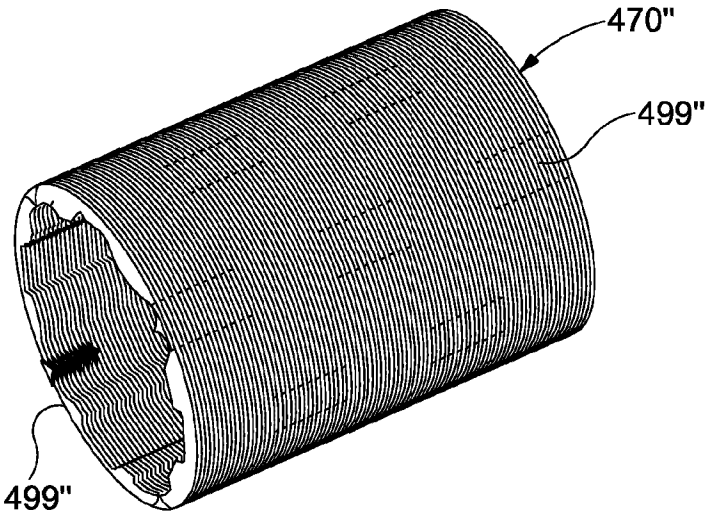
Figure 19D:
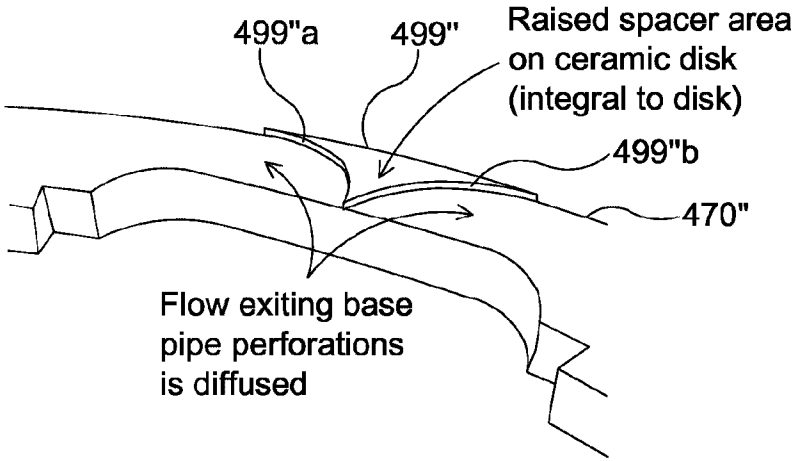

Referring to FIG. 18 there is shown a screen assembly 1000, such as a downhole/sand screen assembly, comprising a first screen 1005*a* and a second screen 1005*b*. The pipe 1025 is non-perforated. The first screen 1005*a* has a higher erosion resistance than the screen 1005*b*. The first screen 1005*a* is a screen according to an embodiment of the present invention, e.g. comprising ceramic discs. The second screen 1005*b* can be a screen according to the prior art.

FIGS. 18(*a*) and 18(*b*) show injection and production fluid flow respectively. The pipe 1025 comprises a port 1040 longitudinally distal the screens 1005*a*, 1005*b*.

For sand screen configurations where production or injection flow enters or exits the base pipe 1025 from a single point at one or either end of the sand screen 1025, the flow will tend to take the path of least resistance and the majority of the flow will enter or exit a section of sleeve 1031*a* or filter media closest to that point. By incorporating a highly erosion resistant portion of the screen 1005*a* closest to the flow port/s 1040, the erosion effect of the high volume, high velocity flow in this area can be mitigated. The screen 1005*a* can comprise ceramic discs. The remainder of the screen 1005*b* area will be less susceptible to erosion due to the reduced flow rates and velocities, therefore, can be made up of a more conventional filter media type such as metal mesh or wire wrap, e.g. of triangular cross-section.

Referring now to FIGS. 16(*a*)-(*i*) there is shown a screen or screen assembly 305', such as a downhole/sand screen or screen assembly, comprising a pipe 325' and a sleeve 331', wherein the pipe 305' comprises a port(s) 362', and where the sleeve 331' comprises a solid or wall portion(s) 390' at or near the port(s) 362'.

The solid or wall portions 390' are provided radially outwardly of the ports 362'.

The pipe 325' can be referred to as a base pipe or production tubing.

The port(s) 362' are provided on the pipe 325' and/or at each end of the pipe, in the latter case the pipe optionally having a solid wall. The solid or wall portion(s) 390' are provided radially adjacent the port(s), i.e. radially outward of the port(s).

This arrangement can provide that injection flow, i.e. high rate injection flow may meet or hit a solid or wall portion, change direction and flow axially along an annulus between the pipe 325' and the sleeve 331'. In this way an area of highest erosion is deflected to an area of pipe 305' having a solid outer wall.

Referring next to FIGS. 13(*a*) and (*b*) and FIGS. 13(*c*) and (*d*), there is shown a screen assembly 890*a*; 890*b*, such as a downhole/sand screen assembly, comprising first and second screens 805*a*; 805*b* longitudinally coupled together, wherein there is provided a fluid flow path 891*a*; 891*b* between the first and second screens 805*a*; 805*b*.

The first screen 805*a*; 805*b* comprises a first pipe 825*a*; 825*b* and a first sleeve 831*a*; 831*b*. The second screen 805*a*; 805*b* comprises a second pipe 825*a*; 825*b* and a second sleeve 831*a*; 831*b*. The first and second pipes 825*a*; 825*b* are coupled by a coupling, i.e. a threaded coupling 892*a*; 892*b*.

The first and second sleeves are coupled, i.e. by first and second support rings 893*a*; 894*a*; 893*b*; 894*b* and a centraliser or further sleeve or screen 895*a*; 895*b*.

The fluid flow path is annular.

Referring to FIGS. 13(*a*) and (*b*), there is shown a screen assembly 890*a*, such as a downhole/sand screen assembly, comprising first and second screens 805*a* longitudinally disposed relative to one another, wherein a centraliser 895*a* is provided between adjacent ends of the first and second screens 805*a*.

A first support ring 893*a* is provided between an end of a sleeve 831*a* of the first screen and a first end of the centraliser 895*a*. A second support ring 894*a* is provided between an end of a sleeve 831*a* of the second screen and a second end of the centraliser 895*a*.

Referring to FIGS. 13(*c*) and (*d*), there is shown a screen assembly 890*b*, such as a downhole/sand screen assembly, comprising first and second screens longitudinally disposed relative to one another, wherein a further screen 895*b* or screen portion is provided between adjacent ends of the first and second screens 805*b*.

A first support ring 893*b* is provided between an end of a sleeve 851*b* of the first screen and a first end of the further screen 895*b*. A second support ring 894*b* is provided between an end of a sleeve 831*b* of the second screen and a second end of the further screen 895*b*.

Referring to FIGS. 19(*a*)-(*d*), there is shown a screen or screen assembly 405", such as a downhole or sand screen or screen assembly, comprising a pipe 425" and a plurality of ceramic discs 470" around the pipe 425".

The ceramic discs 470" are stacked on each other. Gaps between discs 470" determine a size of particulate to be filtered, and can be modified to suit a well and specification of an operator.

At least one spacer 499" is provided between at least two adjacent discs 470", wherein the/each at least spacer 499" is aligned with a respective hole 440" or slot or perforation in the pipe 425".

Such provides enhanced erosion resistance.

The pipe 425" can be referred to as a base pipe or production tubing.

The/each spacer 499" is shaped to diffuse fluid flow exiting a hole 440" or slot of perforation in the pipe 425". The spacer 499" comprises first and second surfaces 499"*a*, 499"*b*. The first and second surfaces 499"*a*, 499"*b* are concave and face in opposing directions. Each of the first and second surface 499"*a*, 499"*b* is radially diverging.

The discs 470" are provided around the pipe 425". Beneficially each spacer 499" is integrally formed with a disc 470". Beneficially each disc 470" and/or each spacer 499" is made from a ceramic material.

As shown in FIG. 19(*c*), in this implementation, a plurality of longitudinally adjacent discs 470" provide a plurality of circumferentially adjacent spacers 499". Such are rotationally aligned with a hole/slot/perforation 440" in the pipe 425".

The discs 470" provide a filter media. Adjacent discs 470" are spaced from one another, e.g. by the spacer(s) 499". The spacer(s) 499" are provided on a surface or face of the/each disc 470". Spacer(s) 499" are provided around the surface or face of the/each disc 470". As can be seen from FIG. 19(*a*) an outer sleeve is provided around the discs 470". The outer sleeve which can be metallic protects the discs 470" during run-in.

Figure 20:
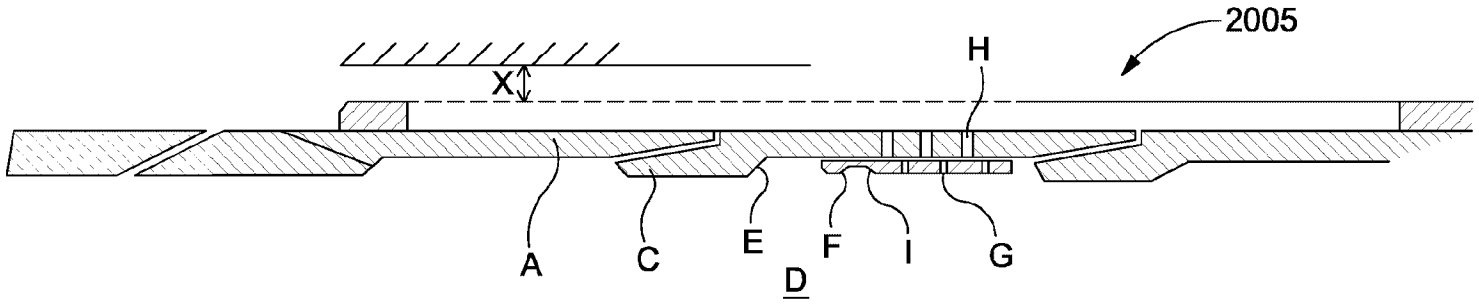
FIG. 20 is a cross-sectional side view of a screen according to an embodiment of the present invention.

Referring to FIG. 20 there is shown a screen or screen assembly, such as a downhole screen or screen assembly 2005.

'X' shows the distance between the inner diameter (ID) of the borehole and the outer diameter (OD) of a sand screen (dashed line). Within the (outer) sand screen (dashed line) is a pipe or base pipe A. In or on the base pipe A is a joint B. The joint B is a threaded connection between two sections of base pipe ('C' indicates threads). The joint B has an additional function—it protrudes into throughbore D and presents an incline E to act as a kick down shoulder. Sleeve F provides ports G. The ports G can be aligned with ports H in the base pipe when the sleeve F is moved. The sleeve F has a recess I on the inner surface (on the left hand side) to accept keys that lock the sleeve F to a shifting tool (not shown).

In operation, keys on a shifting tool are biased outwardly, and as the shifting tool is pulled up the throughbore D, the keys engage with the profile on the inner surface of the sleeve F. Once the shifting tool keys are locked into the sleeve F, the shifting tool is pulled to align the ports G in the sleeve F and the base pipe ports H. Once the sleeve F has reached its full extent of travel, the joint B provides a shoulder stop for the shifting sleeve F and the keys on the shifting tool B. This releases the keys and disengages the shifting tool from the sleeve F. The process can be repeated for the next sleeve etc.

This arrangement provides for "bottom-up opening" of shifting sleeves.

Figure 21:
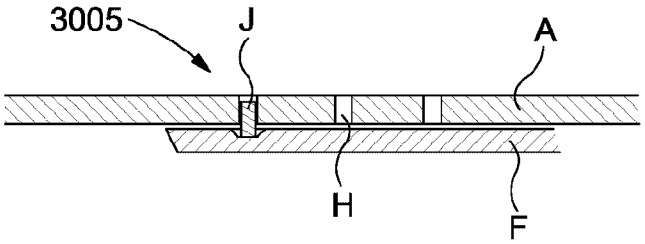
FIG. 21 is a cross-sectional side view of a downhole apparatus or screen according to an embodiment of the present invention.

Referring now to FIG. 21, there is shown a downhole assembly or screen or screen assembly 3005. Pipe A provides lateral ports H. A pin J is in the first of these ports H. The pin J can run in a groove to ensure axial alignment of the sleeve F and restrict rotation. Once the sleeve F has reached the full extent of travel, the pin J can drop into a groove to lock the sleeve F in place. The pin J acts as an anti-rotation key.

It will be appreciated that the embodiments of the present invention may be combined. It will also be appreciated that any feature or features of one embodiment of the invention may be adopted or used in another embodiment of the invention. Any feature(s) described or referenced herein may be combined with any feature(s) of any other embodiment. Thus feature(s) defined in relation to one embodiment may be provided in combination with feature(s) of any other embodiment.

It will be appreciated that in the disclosed embodiments the pipe (or tubular) and/or the sleeve each comprise a hollow cylindrical shape, and are disposed substantially co-axially, the sleeve typically surrounding the pipe. Further:

the wire can comprise wire mesh or wire wrap;

the screen or screen assembly can be configurable for one or more of fluid injection, stimulation, fracturing and/or production;

the pipe comprises production tubing;

the screen or sleeve comprises a second tubular;

the screen or sleeve can be permeable;

the pipe can comprise a perforated tubular member or tubular member having a plurality of ports or can comprise a solid tubular member;

the pipe can comprise a first tubular;

the pipe can be permeable or impermeable;

the pipe can be disposed within the sleeve;

the pipe can define an axial through-bore;

an annulus can be provided between the pipe and the sleeve;

the sleeve, i.e. sliding sleeves can comprise further tubulars and/or;

the wire is circumferentially disposed or wound or wrapped.

It will be appreciated that the embodiments hereinbefore described are given by way of example only and are not meant to be limiting of the scope of the invention in any way. It will be appreciated that the embodiments may be combined. It will be appreciated that one or more features of one embodiment may be adapted or used in another embodiment. Thus any feature(s) of one embodiment may be combined with any feature(s) of any other general solution or aspect.

The aspects/embodiments of the present invention herebefore described provide one or more of:

(i) Axial screen support rods having 'diamond' cross-section (i.e. one 'pointy' end welded to the base pipe and opposing 'pointy' end welded to circumferential screen). This wire shape is in intended to give enhanced erosion resistance. (See FIG. 4).

(ii) Circumferential wire wrap having 'diamond' cross-section. (i.e. one 'pointy' end welded to the axial support rod and opposing 'pointy' end facing the formation). This wire shape is in intended to give enhanced erosion resistance. (See FIG. 6).

(iii) Axial screen support rods having a cross-section of square/rectangular core with triangular ends (i.e. one 'pointy' end welded to the base pipe and opposing 'pointy' end welded to outer circumferential screen with square/rectangular middle section therebetween). This wire shape is in intended to give enhanced erosion resistance. (See FIG. 5).

(iv) Circumferential wire wrap using wire having a cross-section of square/rectangular core with triangular ends (i.e. one 'pointy' end welded to the axial support rod and the opposing 'pointy' end facing the formation with square/rectangular middle section therebetween). This wire shape is in intended to give enhanced erosion resistance. (See FIG. 7).

(v) Wire wrap screen or axial support rods having square cross-section. In this case, the lack of 'pointy' end may result in less turbulence and therefore lower erosion rates. This wire shape is in intended to give enhanced erosion resistance. (See FIGS. 8(*a*) and (*b*)).

(vi) Any combination of screen construction using axial supports and circumferential screen from (i)-(v).

(vii) Coated wire/hardened wire. Can be used with any wire screen arrangement. One example of the hardening process is hardide tungsten carbide chemical vapour deposition (CVD). CVD can be applied to steel. The wire would need to be coated in shorter lengths then made up/assembled into longer continuous lengths of screened pipe. (See FIGS. 3(*a*) and (*b*) or FIG. 6, FIG. 7 or FIGS. 8(*a*) and (*b*)).

(viii) Stacks of ceramic disks overlaid on the base pipe (either slotted or solid). This provides screen with enhanced erosion resistance. (See FIGS. 9(*a*)-(*e*) and FIGS. 14(*a*) and (*b*)).

(ix) Microporous sand screen made from foamed metal or ceramic over slotted or solid base pipe (again the solid base pipe would need opening(s) at the end to deliver injection fluid to the annulus). Pore size can be adjusted to suit the requirements of the client. This provides screen with enhanced erosion resistance. (See FIGS. 10(*a*)-(*e*)).

(x) Foamed screen made from metal or ceramic that is bonded with the exterior of the base pipe, but with axial opening or slots (daisy passages) running along the exterior of the base pipe to deliver fluid to the foamed screen. This provides screen with enhanced erosion resistance on solid base pipe, but allowing for even distribution of injection fluids. (See FIGS. 10(*a*)-(*c*)).

(xi) Perforated base pipe, each perforation having an associated check valve. The check valve is initially provided to isolate the ID and the OD of the base pipe, but the presence of multiple holes in the base pipe allows more even distribution of the injection fluid. This can be used with any of the enhanced erosion screen concepts or conventional screen. (See FIGS. 10(*a*)-(*c*) or FIGS. 11(*a*)-(*i*)).

(xii) Perforated base pipe with internal shift sleeve. Shift sleeves can have holes that align with the closest portion of pipe when open, but which are misaligned over the pipe in the closed position. The presence of multiple holes in the base pipe allows more even distribution of the injection fluid. This can be used with any of the enhanced erosion screen concepts or conventional screen. (See FIGS. 12(*a*)-(*f*)).

(xiii) Perforated base pipe with multiple shift sleeves, each sleeve ranging between around 1 to 30 foot. The screens can be linked by flexible sections and glide rings provided to reduce friction. The shifting sleeves can make use of O-rings/bonded seals/reed valves/check valves. Screens are initially closed, then opened before injection operations commence to spread the flow. (See FIGS. 12(*a*)-(*f*)).

(xiv) Perforations in the base pipe sealed by thin steel flaps (reed valves). The presence of multiple holes in the base pipe allows more even distribution of the injection fluid. This can be used with any of the enhanced erosion screen concepts or conventional screen. (See FIGS. 9(*a*)-(*e*) and FIGS. 12(*a*)-(*f*)).

(xv) Perforations sealed by 'knock-out' plugs. The presence of multiple holes in the base pipe allows more even distribution of the injection fluid. This can be used with any of the enhanced erosion screen concepts or conventional screen. (See FIGS. 12(*a*)-(*f*)).

(xvi) Solid base pipe with split screen, i.e. a length of high erosion resistant screen in high flow areas (i.e. a certain distance range from the openings)—any of concepts (i) to (ix), followed by a longer length of normal triangular section wire wrap over the remaining area that experiences lower flow rates. (See FIGS. 18(*a*)-(*b*)).

(xvii) Screen (any known type or (i) to (vii) that has solid areas near injection flow openings, (such as at ends of solid base pipe and over holes in perforated base pipe). This allows the high rate injection flow to hit a solid section, change direction and flow axially along the annulus between base pipe and screen so that the potential area of highest erosion is at a portion of solid pipe rather than screen. The solid part can be a ring wrapped over the top of the screen or joined to adjacent sections of screen. (See FIGS. 16(*a*)-(*d*)).

(xviii) Coupling between adjacent screen joints provides a flow path and is also a centraliser (dual function). (See FIGS. 13(*a*) and (*b*)).

(xix) Coupling between adjacent screen joints provides a flow path and is also screen. (See FIGS. 13(*c*) and (*d*)).

What is claimed is:

1. A downhole screen, comprising:

a pipe having a plurality of first ports; and a valve member comprising at least one reed valve, the valve member being longitudinally slideable, the at least one reed valve being selectively alignable in or out of alignment relative to at least one of the first ports with the longitudinal sliding of the valve member.

2. The downhole screen according to claim 1, wherein the at least one reed valve, in use, is initially provided to isolate the inner diameter of the pipe from the outer diameter of the pipe.

3. The downhole screen according to claim 1, wherein the valve member is biased into a closed position.

4. The downhole screen according to claim 1, wherein the valve member comprises one or more sliding sleeves.

5. The downhole screen according to claim 4, wherein the one or more sliding sleeves slide relative to an inner surface of the pipe.

6. The downhole screen according to claim 5, wherein each of the one or more sliding sleeves comprises one or more second ports controllably alignable with one or more of the first ports of the pipe.

7. A downhole screen assembly, comprising a first screen according to claim 1, and a second screen.

8. The downhole screen assembly according to claim 7, wherein the first screen and the second screen are longitudinally disposed relative to one another.

9. The downhole screen assembly according to claim 7, wherein the first screen comprises or includes a microporous material, a ceramic material, a foamed ceramic or metal, or ceramic discs.

10. The downhole screen assembly according to claim 7, wherein the second screen comprises wire having a cross-section comprising a triangular shape or a square shape.

11. The downhole screen according to claim 1, wherein the selective alignment between the at least one reed valve and the at least one first port of the pipe is a longitudinal alignment.

12. The downhole screen according to claim 1, further comprising a plurality of ceramic discs disposed around the pipe, one or more of the discs arranged so as to provide circumferential spaces between the pipe and the one or more discs; wherein the valve member is provided between at least one of the first ports and a respective one of the circumferential spaces.

13. The downhole screen of claim 1, wherein the first ports in the pipe comprise pipe ports, perforations, holes, or slots.

* * * * *